United States Patent [19]

Kaneko

[11] Patent Number: 4,913,426

[45] Date of Patent: Apr. 3, 1990

[54] SORTER

[75] Inventor: Tamaki Kaneko, Fujisawa, Japan

[73] Assignee: O/A Technologies, Inc., Irvine, Calif.

[21] Appl. No.: 353,210

[22] Filed: May 17, 1989

Related U.S. Application Data

[63] Continuation of Ser. No. 159,416, Feb. 16, 1988, abandoned, which is a continuation of Ser. No. 943,689, Dec. 19, 1986, abandoned.

[30] Foreign Application Priority Data

| | | | |
|---|---|---|---|
| Dec. 20, 1985 | [JP] | Japan | 60-287295 |
| Dec. 20, 1985 | [JP] | Japan | 60-287296 |
| Dec. 23, 1985 | [JP] | Japan | 60-196478[U] |
| Dec. 30, 1985 | [JP] | Japan | 60-298335 |
| Dec. 30, 1985 | [JP] | Japan | 60-298336 |
| Dec. 30, 1985 | [JP] | Japan | 60-298337 |
| Jan. 17, 1986 | [JP] | Japan | 61-006317 |
| Jan. 17, 1986 | [JP] | Japan | 61-006318 |
| Feb. 17, 1986 | [JP] | Japan | 61-030748 |
| Aug. 20, 1986 | [JP] | Japan | 61-194155 |
| Oct. 23, 1986 | [JP] | Japan | 61-250750 |

[51] Int. Cl.[4] ..... B65H 39/10

[52] U.S. Cl. ..... 271/296; 271/290; 271/298; 271/300

[58] Field of Search ..... 271/296, 287–290, 271/298, 299, 300, 176, 184; 270/58

[56] References Cited

U.S. PATENT DOCUMENTS

| | | | |
|---|---|---|---|
| 4,026,543 | 5/1977 | Leclere | 271/290 X |
| 4,322,069 | 3/1982 | Mitchell | 271/296 |
| 4,405,225 | 9/1983 | Perrault | 271/296 X |
| 4,445,680 | 5/1984 | Kikuchi et al. | 271/296 X |
| 4,624,546 | 11/1986 | Fukushi et al. | 271/296 X |

FOREIGN PATENT DOCUMENTS

| | | | |
|---|---|---|---|
| 55-66453 | 5/1980 | Japan . | |
| 2059397 | 4/1981 | United Kingdom | 271/296 |

*Primary Examiner*—Kevin P. Shaver
*Assistant Examiner*—David H. Bollinger
*Attorney, Agent, or Firm*—Oblon, Spivak, McClelland, Maier & Neustadt

[57] ABSTRACT

A sorter having a plurality of receptacles vertically disposed at given intervals includes a lift member for receiving a copied sheet. The lift member is vertically movable between a home position at which it can receive a sheet and positions corresponding to those of the receptacles. The lift member includes a pair of discharge rollers controlled so as to pinch a sheet being discharged to the sorter while the lift member is vertically moving between the home position and the level of one of the receptacles.

17 Claims, 40 Drawing Sheets

SORTER

This application is a continuation of application Ser. No. 159,416, filed on Feb. 16, 1988, now abandoned, which is a continuation application of Ser. No. 943,689, filed 12/19/86, now abandoned.

FIELD OF THE INVENTION

This invention relates to a sorter which classifies and stacks, onto a plurality of receptacles, recorded sheets of paper discharged from an image recording device for an electronic copying machine, printer, etc.

RELATED ART STATEMENT

Heretofore there has been known a sorter which consists of a plurality of receptacles vertically disposed at given intervals, a recorded paper carrier having a belt disposed close to the receptacles to carry recorded sheets of paper upwards or downwards and a suction fan drawing the recorded sheets into the belt, a lift member disposed and vertically movable between the recorded paper carrier and the receptacles, a direction change member disposed at the lift member to direct to a desired receptacle a traveling direction of recorded sheets of paper being transferred by the recorded paper carrier, and a pair of paper discharge rollers disposed at the lift member to discharge, on a desired receptacle, recorded sheets whose direction was changed by the direction change member.

The aforesaid sorter, however, must change a transfer direction of recorded sheets of paper on a recorded paper carrier for a variety of discharge position heights of recorded sheets in an image recording device (for example, the belt must be transferred from lower to upper when recorded sheets are discharged at the lower position of the image recording device and on the other hand the belt must be transferred from upper to lower when discharged at the upper position). Therefore, a direction change member configuration must be changed between a case where the direction of recorded sheets being transferred from below is changed and another case where the direction of recorded sheets being transferred from above is changed. Such change of the direction change member configuration to meet circumstances is extremely troublesome.

In addition, a direction change member, which must change directions of recorded sheets being transferred from either upper and lower directions, may involve an extremely complicated configuration.

OBJECT AND SUMMARY OF THE INVENTION

In view of the above, it is the object and purpose of the invention to provide a sorter which can classify and stack, on a plurality of receptacles, recorded sheets of paper transferred at a variety of discharge positions using a simplified configuration.

In a sorter according to the invention, the aforesaid object can be accomplished by providing a plurality of receptacles vertically disposed at given intervals, a lift member disposed close to these receptacles and movable up and down, a lift driver to raise and lower the lift member, a recorded paper pincher disposed at the aforesaid lift member to momentarily hold a recorded sheet being transferred, and a pair of paper discharge rollers disposed at the aforesaid lift member to discharge recorded sheets onto the receptacles, and by keeping the aforesaid lift member on standby at a given position, moving the lift member to a desired position while holding a recorded sheet being transferred with a recorded paper pincher, and then discharging the recorded sheet on the desired receptacle by the paper discharge rollers as well as by returning back the lift member to the given home position.

BRIEF DESCRIPTION OF THE DRAWINGS

In the accompanying drawings, there are shown illustrative embodiments of the invention from which these and other of its objectives, novel features and advantages will be readily apparent.

In the drawings.

DETAILED DESCRIPTION OF PREFERRED EMBODIMENTS

Figure 1:
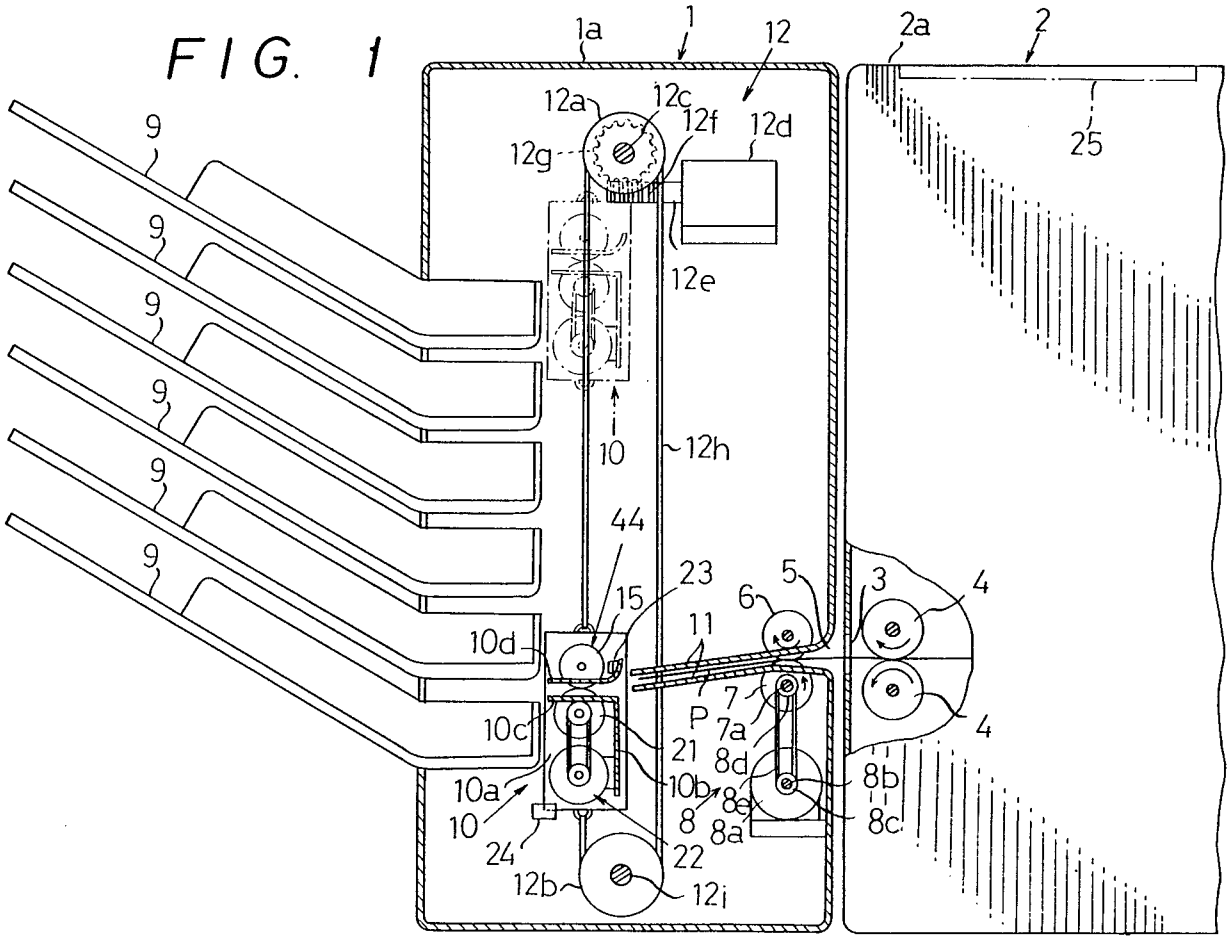
FIG. 1 is a side sectional view of a first embodiment.

In FIG. 1, Numeral 1 is a sorter. An electronic copying machine 2 is disposed in juxtaposition to an outer casing 1*a* of the sorter 1. In an outer casing 2*a* of the electronic copying machine 2, a paper discharge port 3 is formed to discharge recorded sheets of paper P to the sorter 1. Inside the outer casing 2*a* in the vicinity of the paper discharge port 3, a pair of paper discharge rollers 4 are disposed.

Opposite to the paper discharge port 3 in the outer casing 2*a* of the aforesaid electronic copying machine 2, a paper receive port 5 is formed in the outer casing 1*a* of the sorter 1. A pair of paper receive rollers 6 and 7 are disposed inside the outer casing 1*a* adjoining the paper receive port 5. The receive rollers are pressed to each other, with one receive roller 7 being rotated by a receive roller driver 8, which consists of a motor 8*a* securely fixed to the outer casing 1*a*, a pulley 8*c* fixed to a drive shaft 8*b* in the motor 8*a*, another pulley 8*d* fixed to a revolving shaft 7*a* on the receive roller 7, and a belt 8*e* looped over these pulleys 8*c* and 8*d*.

On a paper-feed direction side of the aforesaid receive rollers 6 and 7, a plurality of receptacles 9 are vertically disposed at given intervals. These receptacles 9 are supported by the outer casing 1*a*, and the best part of these receptacles 9 extends out of an opening of the outer casing 1*a*.

Between the aforesaid receive rollers 6 and 7 and the receptacles 9, a lift member 10 is disposed next to the receptacles 9 and can be moved vertically. Between the aforesaid receive rollers 6 and 7 and the lift member 10, a paper guide member 11 is disposed to guide recorded sheets of paper P. The aforesaid lift member 10 is raised by a lift driver 12, which consists of two pairs of pulleys 12*a* and 12*b* disposed vertically apart opposite to each other, a reversible step motor 12*d* disposed close to a revolving shaft 12*c* of the upper pulleys 12*a*, a worm gear 12*f* fixed to a drive shaft 12*e* of the step motor 12*d*, a wheel gear 12*g* fixed to the revolving shaft 12*c* of the pulleys 12*a* to engage with the worm gear 12*f*, and a pair of wires 12*h* looped over the aforesaid pulleys 12*a* and 12*b* to which side plates 10*a* (only one side plate seen in FIG. 1) of the lift member 10 are fixed.

Both ends of the revolving shaft 12*c* and 12*i* of the respective pulleys 12*a* and 12*b* are supported with bearings fixed to the outer casing 1*a*. The aforesaid step motor 12*d* is also fixed to the outer casing 1*a*.

Figure 2:
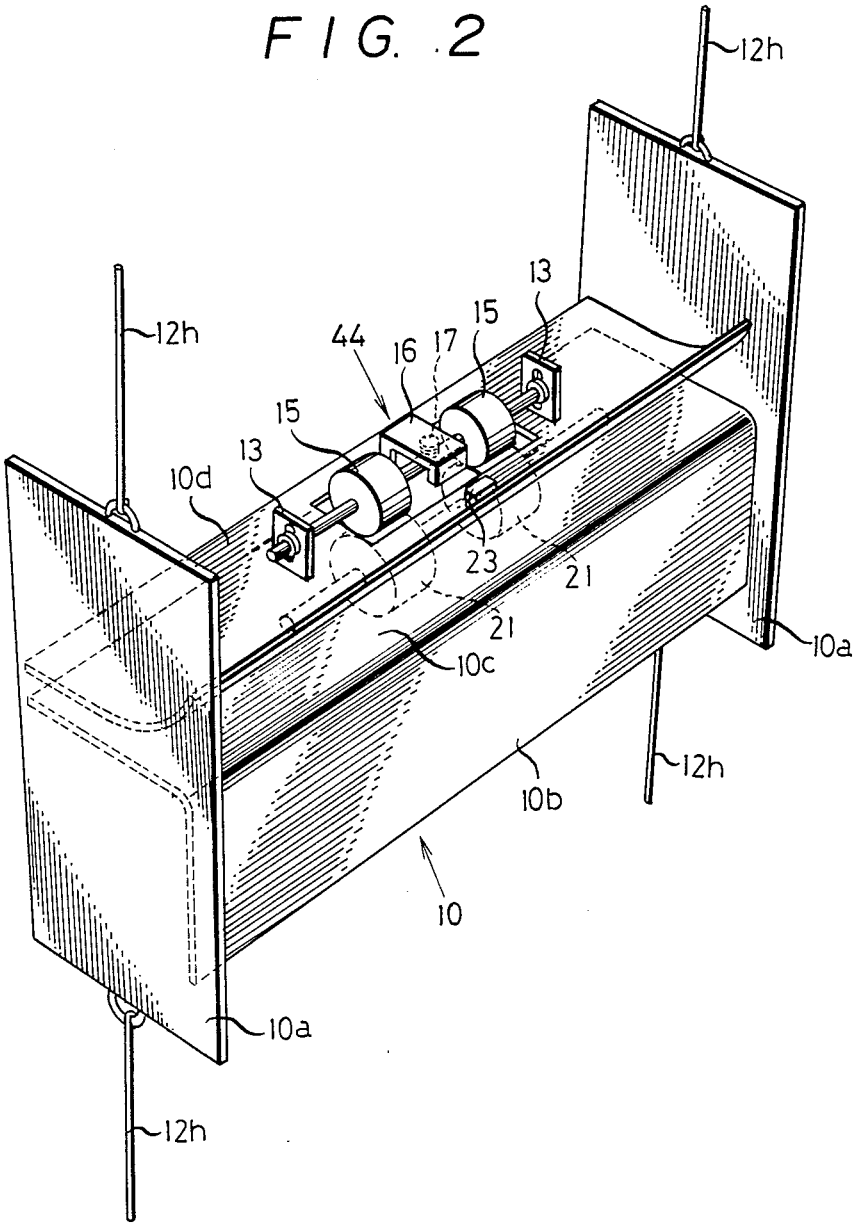
FIG. 2 is a perspective view of a typical lift member.
Figure 3:
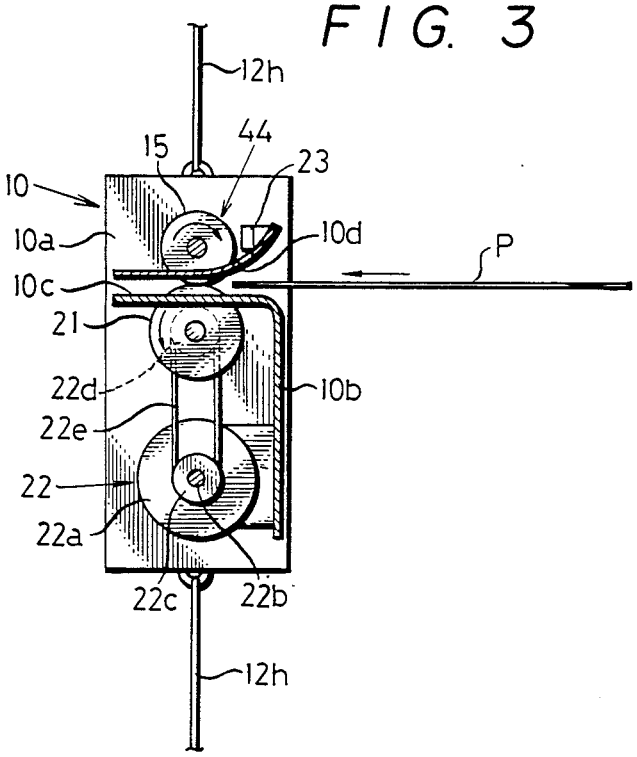
FIG. 3 is a side sectional view of the lift member.

As shown in FIGS. 2 and 3, the aforesaid lift member 10 consists of the side plates 10*a* and a hold plate 10*b* integrally fixed thereto. In the lift member 10, two guide members 10*c* and 10*d* are disposed to guide recorded sheets P being pushed out by the receive rollers 6 and 7.

Figure 4:
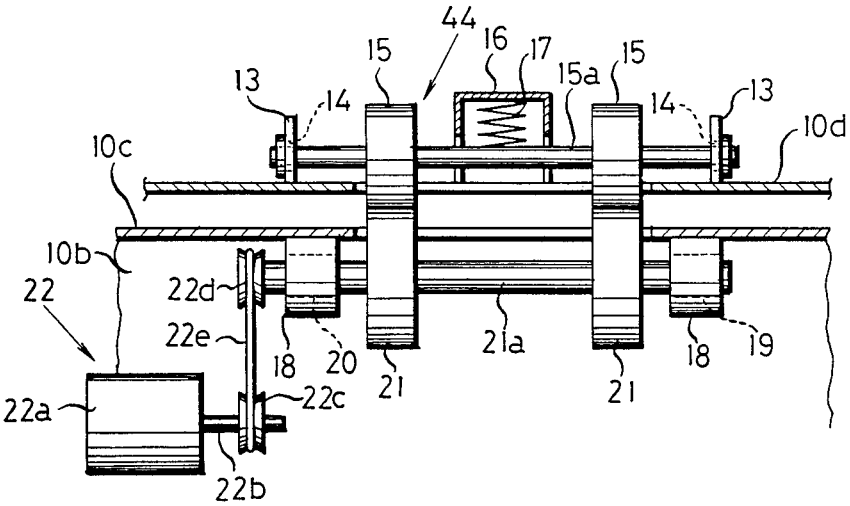
FIG. 4 is a fragmentary front view of the lift member.

As shown in FIG. 4, from the upper guide member 10*d* extend out two support members 13, in which bearings 14 are disposed to slide vertically a little distance through slotted holes. And, a revolving shaft 15*a* for paper discharge rollers 15 is supported with these bearings 14. From the aforesaid guide member 10*d* projects out a hold member 16, which houses a spring 17 to press down the revolving shaft 15*a* for the paper discharge rollers 15.

From the aforesaid guide member 10*c* extends out two support members 18, that incorporate respectively a one-way clutch 19 and a bearing 20, by which is supported a revolving shaft 21*a* for separate paper discharge rollers 21. The paper discharge rollers 21 are rotated by a paper discharge roller driver 22, which consists of a motor 22*a* fixed to the hold plate 10*b* in the lift member 10, a pulley 22*c* secured to a drive shaft 22*b* of the motor 22*a*, another pulley 22*d* fixed to the revolving shaft 21*a* for the paper discharge rollers 21 and disposed opposite to the pulley 22*c*, and a belt 22*e* looped over these pulleys 22*c* and 22*d*. The aforesaid one-way clutch 19 permits the paper discharge rollers 21 to rotate in such a direction as to transfer recorded sheets P toward the receptacles 9, but does not permit the paper discharge rollers to rotate adversely to the aforesaid direction.

Near the aforesaid paper discharge rollers 15 and 21 between the paper discharge rollers 15 and 21 and the receive rollers 6 and 7 is disposed a paper sensor 23, which is of a photosensor type and is fixed to the guide member 10*d*. To detect that the aforesaid paper discharge rollers 15 and 21 have been deployed to a home position where they receive recorded sheets sent from the receive rollers 6 and 7, at a point on the lift member 10 is disposed a roller home position sensor 24, which is also of a photosensor type to identify that the paper discharge rollers 15 and 21 have reached the home position by detecting that the side plate 10*a* on the lift member 10 has reached a desired position.

When a recorded sheet P is sent in between the aforesaid receive rollers 6 and 7 from the paper discharge rollers 4 in the electronic copying machine, the receive rollers 6 and 7 transfer the recorded sheet P toward the paper discharge rollers 15 and 21. At the moment, the paper discharge rollers 15 and 21 stand by without rotation at a home position to receive the recorded sheet P (FIG. 1 shows a case where the home position matches the lowest receptacle 9). When the aforesaid paper sensor detects a leading edge of the recorded sheet P, the paper discharge rollers 15 and 21 rotate only for a short time enough to transfer the recorded sheet P toward the receptacle, until the paper discharge rollers 15 and 21 pinch the leading edge of the recorded sheet P. Then, they come to a halt.

At the instant when the aforesaid paper discharge rollers 15 and 21 have succeeded in pinching the recorded sheet P, the lift member 10 or the paper discharge rollers 15 and 21 comes to a stop at a position matching a target receptacle 9 after moving toward the receptacle. While the lift member 10 and the paper discharge rollers 15 and 21 are moving, since the one-way clutch 19 does not permit the paper discharge roller 21 to rotate in a direction adverse to that for sending the recorded sheet P toward the receptacles 9, there is no chance that the recorded sheet P can get free of the paper discharge rollers 15 and 21. A motion speed of the paper discharge rollers 15 and 21 in moving toward a target receptacle 9 is set to a speed similar to a paper feed speed of the paper discharge rollers 4 in an electronic copying machine. Therefore, while the paper discharge rollers 15 and 21 are moving along, the similar speeds keep a recorded sheet P from getting out of the paper discharge rollers 15 and 21, by eliminating an undesirable resistance force acting on the recorded sheet P.

On having come to a position matching a target receptacle 9, the aforesaid paper discharge rollers 15 and 21 begin to rotate to discharge a recorded sheet of paper P onto the receptacle 9, and stop rotation a certain short time after the paper sensor's 23 detection of a trailing edge of the recorded sheet P, after which the lift member 10 and the paper discharge rollers 15 and 21 returns to the home position at a speed which may be larger than a feed speed of recorded sheets P by the paper discharge rollers 4 in an electronic copying machine 2, because at this time the paper discharge rollers 15 and 21 have nothing to do with pinching of sheets P.

Figure 5:
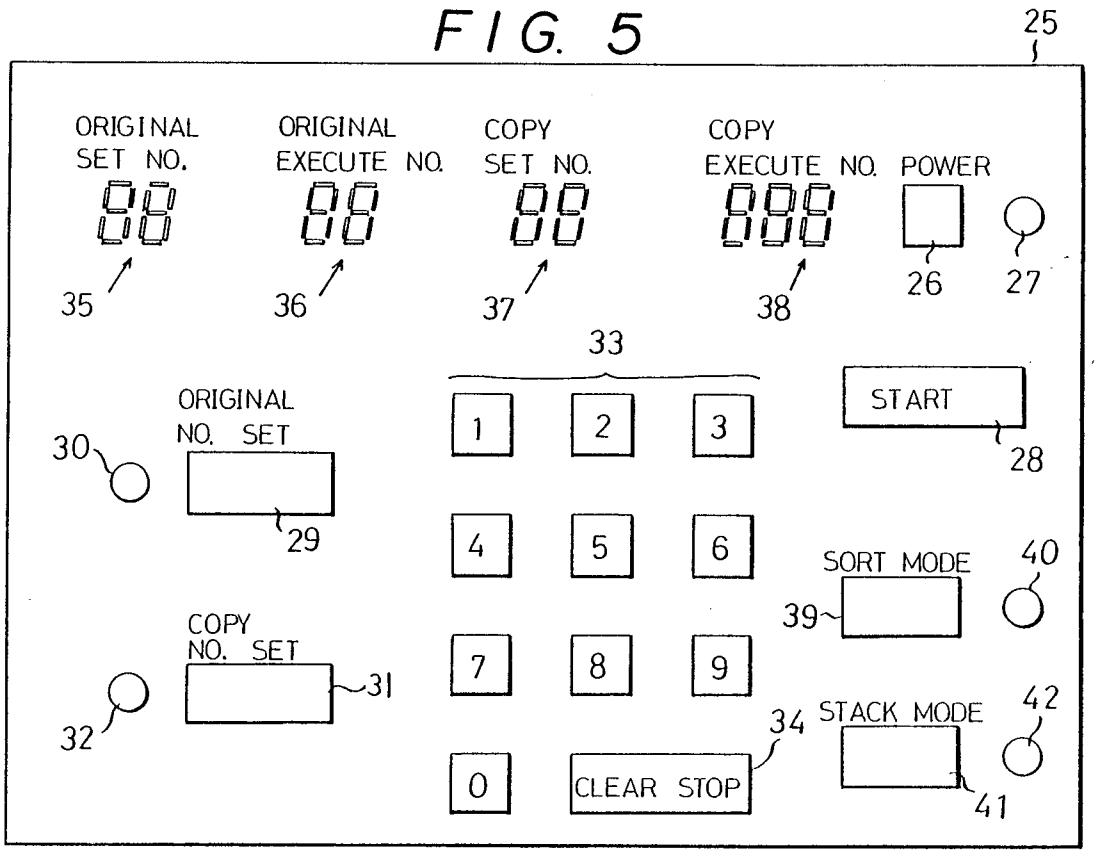
FIG. 5 is a plan view of an operation indicating panel.

FIG. 5 shows an operation indicating panel 25 disposed on an upper face of the outer casing 2*a* covering the aforesaid electronic copying machine 2. The operation is as follows:

On the operation indicating panel 25 there are such a variety of functional parts as follows; a power key 26 turning power ON or OFF, a power indicator 27 giving visual presentations of power ON or OFF, a START key 28 initiating copying operation, an original No. set key 29 for setting original No., an original No. set indicator 30 showing the original No. set key 29 ON or NOT, a copy No. set key for setting copy No., a copy No. set indicator 32 showing the copy No. set key 31 ON or NOT, a set of ten keys 33 for inputting original No. or copy No., a clear stop key 34 for clearing inputted Nos. by the ten keys 33 as well as for stopping copy, an original set No. indicator 35 showing the number of original sets, an original execute No. indicator 36 showing the number of original sheets having been copied, a copy set No. indicator 37 giving the number of sets to be copied, a copy execute No. indicator 38 showing the number of copied sheets P, a sort mode key 39 for setting sort mode, a sort mode indicator 40 showing if sort mode has been set or not, a stack mode key 41 for setting stack mode and a stack mode indicator 42 showing if stack mode has been set or not.

When the ten keys 33 are typed after the aforesaid original No. set key 29 is turned ON, a number of originals to be copied is inputted, and when the ten keys 33 are typed after the aforesaid copy No. set key 31 is turned ON, a number of recording sets to be copied is inputted. The aforesaid "sort mode" refers to a mode where every recorded sheet P is stacked in turn on every receptacles 9. And, the aforesaid "stack mode" refers to a mode where recorded sheets P are stacked, first, on a first receptacle to its full capacity, and, second, on a second receptacle also to its full capacity, and so on in turn.

Figure 6:
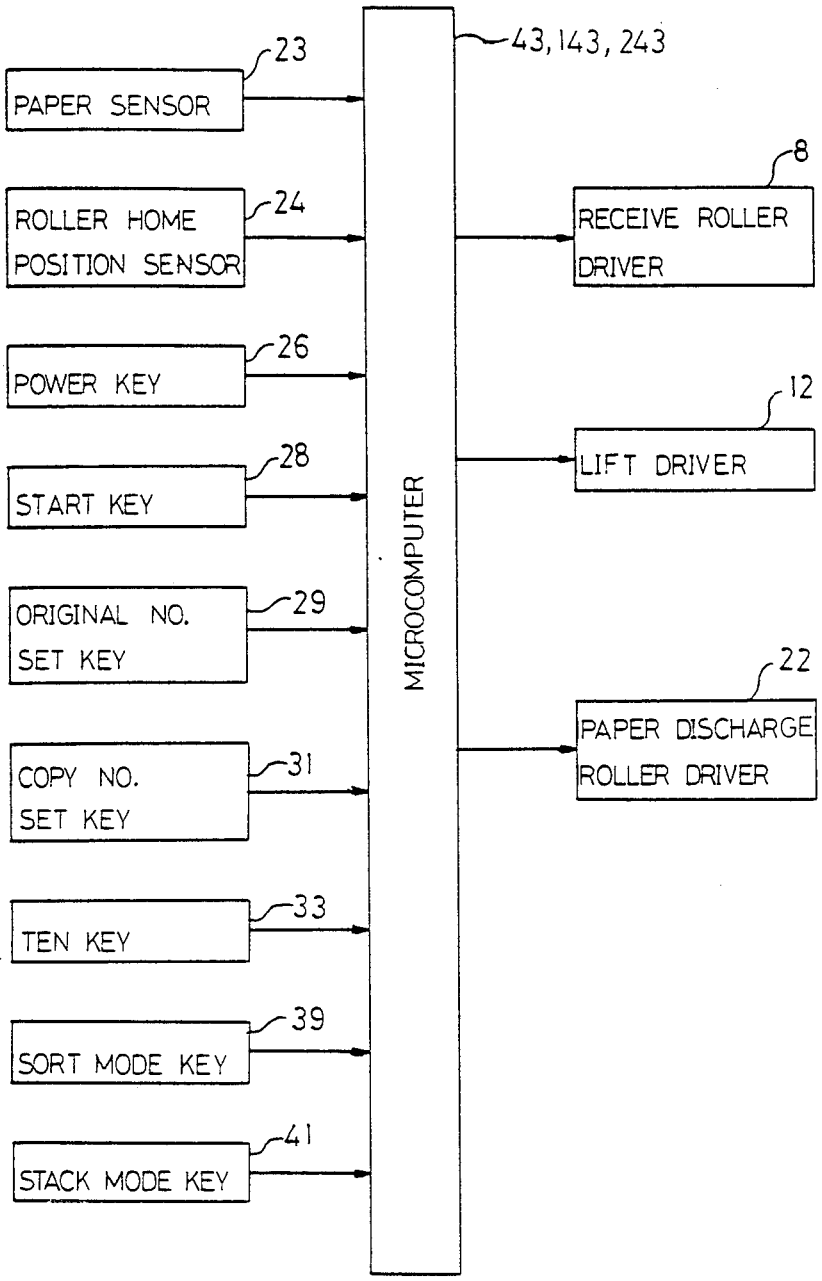
FIG. 6 is a block diagram of a control device of the first embodiment.

FIG. 6 shows a control device for the aforesaid sorter 1. The operation is as follows:

Information such as from the aforesaid paper sensor 23, the roller home position sensor 24, the power key 26, the START key 28, the original No. set key 29, the copy No. set key 31, the ten keys 33, the sort mode key 39 and the stack mode key 41 is inputted into an input port of a microcomputer 43.

Stored in RAM in the aforesaid microcomputer 43 are data from an original No. set counter, a copy set No. counter, a total copy set No. counter, a discharged sheet No. counter, a sort mode flag, a target receptacle No. counter and a lift flag. The aforesaid sort mode flag becomes "1" when the sort mode key 39 is turned ON, and becomes "0" when the stack mode key is turned ON. The aforesaid target receptacle No. counter counts a number of target receptacles being used in sort mode, and equals the value of the copy set No. counter. The aforesaid lift flag becomes "1" when a lift member 10 is raised, and becomes "0" when lowered.

To an output port in the aforesaid microcomputer 43 are connected the receive roller driver 8, the lift driver 12, the paper discharge roller driver 22 and so on.

Figure 7A:
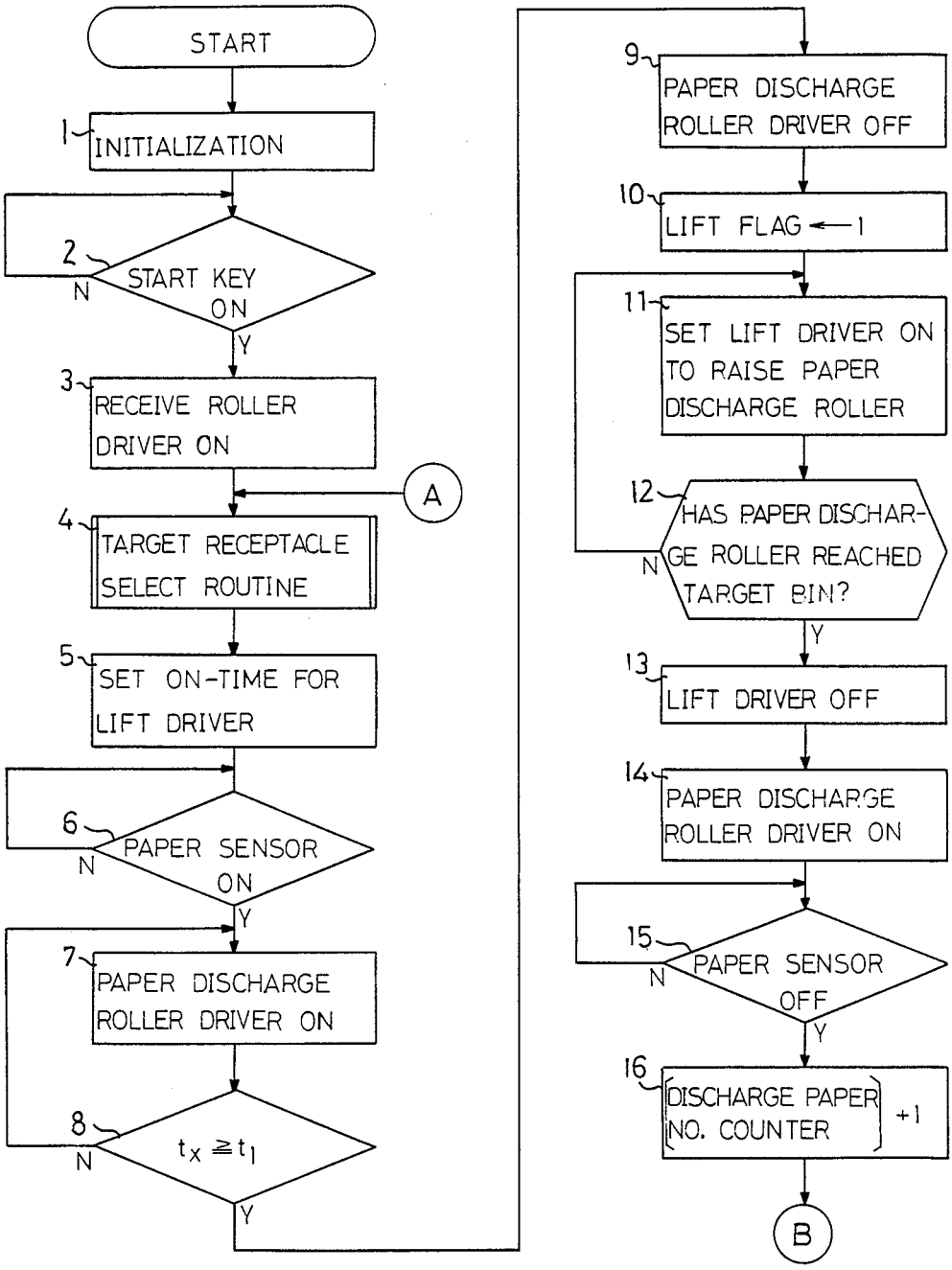
FIGS. 7*a*, 7*b* and 8 are control flow charts of the first embodiment.
Figure 7B:
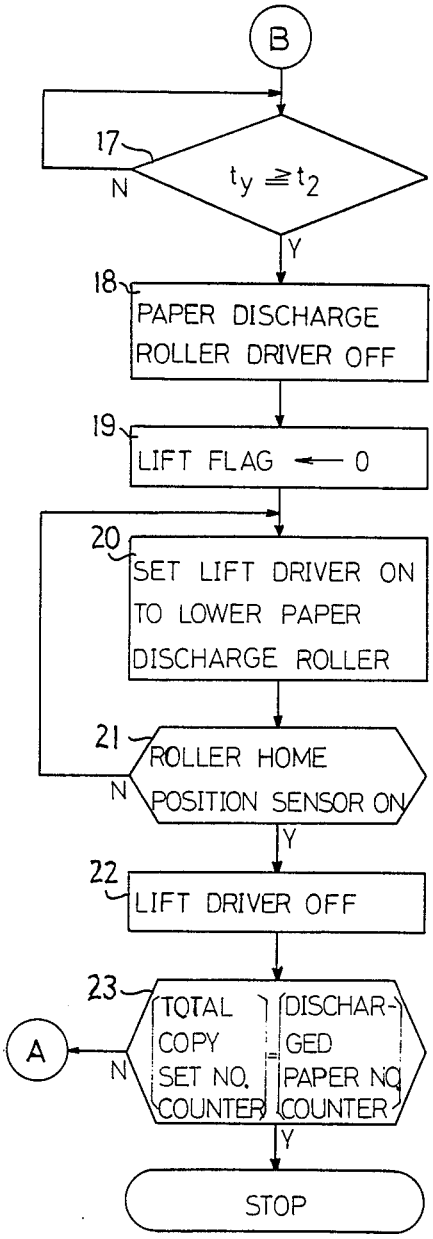
Figure 8:
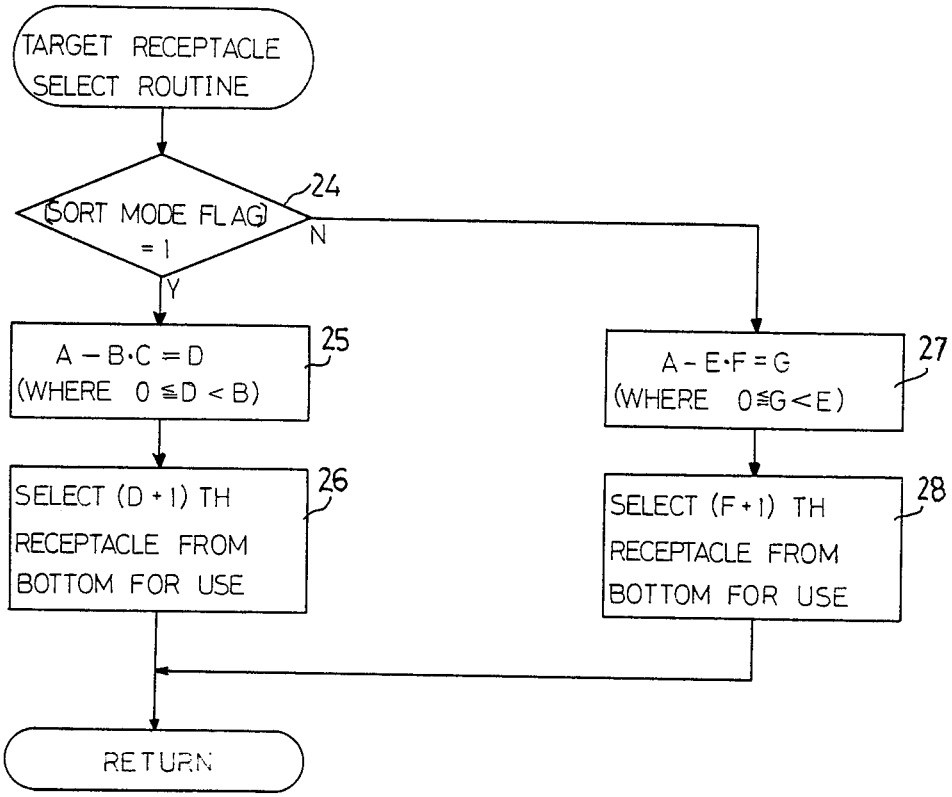

FIGS. 7 and 8 illustrate in detail how the aforesaid sorter 1 operates. The flow charts shown in FIGS. 7 and 8 show one typical example when a home position, where the paper discharge rollers 15 and 21 receive recorded sheets P, happens to match the lowest receptacle 9.

When a signal of the aforesaid power key ON is sent to the microcomputer 43, operation is executed according to a program (shown in the flow charts in FIGS. 7 and 8) incorporated in ROM in the microcomputer 43. FIGS. *7a* and *7b* show a main routine of the flow, and FIG. 8 a subroutine.

First, Step 1 initializes the sorter system to clear data in the RAM and the I/O ports in the microcomputer 43.

Second, Step 2 checks if the START key 28 is turned ON or not. If the Step 2 determines that the START key 28 has been turned on, Step 3 turns ON the receive roller driver 8, and then, through Step 4, a target receptacle select routine, Step 5 sets ON-time of the lift driver 12 in accordance with a target receptacle 9 selected by the target receptacle select routine.

Then, Step 6 checks if the paper sensor 23 has been turned ON or not. If Step 6 determines that the paper sensor 23 has been ON, i.e., the paper sensor 23 has detected a leading edge of recorded sheet P, Step 7 turns ON the paper discharge roller driver 22, and then Step 8 checks if $t_x$ is larger than or equal to $t_1$ or not. Here, $t_x$ is an elapse time from the instant when the paper sensor 23 became ON, and $t_1$ a time, from the instant when the paper sensor 23 became ON (when the paper discharge roller driver 22 was turned ON), required for the paper discharge rollers 15 and 21 to pinch the leading edge of recorded sheet P.

If the aforesaid Step 8 determines that $t_x$ is larger than or equal to $t_1$, Step 9 turns OFF the paper discharge roller driver 22, Step 10 makes the lift flag "1", Step 11 turns ON the lift driver 12 to raise the paper discharge rollers 15 and 21. Next, Step 12 checks if the paper discharge rollers 15 and 21 have reached or not a receptacle 9 selected by the Step 4, target receptacle select routine, in other words, checks if the lift driver 12 is kept ON or not for the ON-time period of the lift driver 12 set in the Step 5.

If the Step 12 determines that the paper discharge rollers 15 and 21 have not reached the selected receptacle 9, the flow is returned to the Step 11 to keep ON the lift driver 12. If the Step 12 determines that the paper discharge rollers 15 and 21 have reached the selected receptacle 9, Step 13 turns OFF the lift driver 12, and, after Step 14 turns ON the paper discharge roller driver 22, Step 15 checks if the paper sensor 23 is OFF or not.

If the Step 15 determines that the paper sensor 23 is OFF, or the paper sensor 23 detects the trailing edge of recorded sheet P, Step 16 adds "1" to a value of recorded sheet discharged No. counter and then Step 17 checks if $t_y$ is larger than or equal to $t_2$ or not, where $t_y$ is an elapse time from the instant when the Step 15 determined that the paper sensor 23 was OFF, and $t_2$ is a time, from the instant when the Step 15 determined that the paper sensor 23 was OFF, required for recorded sheet P discharged by the paper discharge rollers 15 and 21 to get out of the paper discharge rollers 15 and 21.

If the aforesaid Step 17 determines that $t_y$ is larger than or equal to $t_2$, Step 18 turns the paper discharge roller driver 22 OFF, Step 19 makes the lift flag "0", and then Step 20 turns the lift driver ON to lower the paper discharge rollers 15 and 21. Next, Step 21 checks if the roller home position sensor 24 is turned ON or not. If Step 21 determines that the roller home position sensor 24 is not turned ON, the flow is returned back to the Step 20 to keep the lift driver 12 ON.

If the aforesaid Step 21 determines that the roller home position 24 is ON Step 22 turns the lift driver 12 OFF to have the paper discharge rollers 15 and 21 standing by at the home position, and then Step 23 checks if a value of the total copy set No. counter equals a value of the discharged sheet No. counter or not. If the Step 23 determines that a value of the total copy set No. counter does not equal a value of the discharged sheet No. counter, the flow is returned to the Step 4. When the Step 23 determines that a value of the total copy set No. counter equals a value of the discharged sheet No. counter, a complete cycle of this operation is over.

FIG. 8 shows the flow chart of the target receptacle select routine, the Step 4 in FIGS. *7a* and *7b*. The operation procedure is as follows:

First, Step 24 checks if a value of the sort mode flag equals "1" or not. If the Step 24 determines the sort mode flag=1, that is, the present mode is "sort mode", Step 25 finds C and D to satisfy $A-BC=D$ (where $0 \leqq D < B$), where the aforesaid A is a value of the discharged sheet No. counter, B is a value of the stacked receptacle No. counter, and C and D are zero or positive integers. Using the D solved in the Step 25, Step 26 selects a (D+1) th receptacle 9 from bottom as a target receptacle and returns the flow back to the main routine.

If the aforesaid Step 24 determines that a value of the sort mode flag is not "1", Step 27 finds F and G to meet $A-EF=G$ (where $0 \leqq G < E$), where E is a maximum number of recorded sheets P stacked on a receptacle 9, and F and G are zero or positive integers. Using the F solved in the Step 27, 28 selects a (F+1) th receptacle from bottom as a target receptacle 9 and returns the flow back to the main routine.

Figure 9:
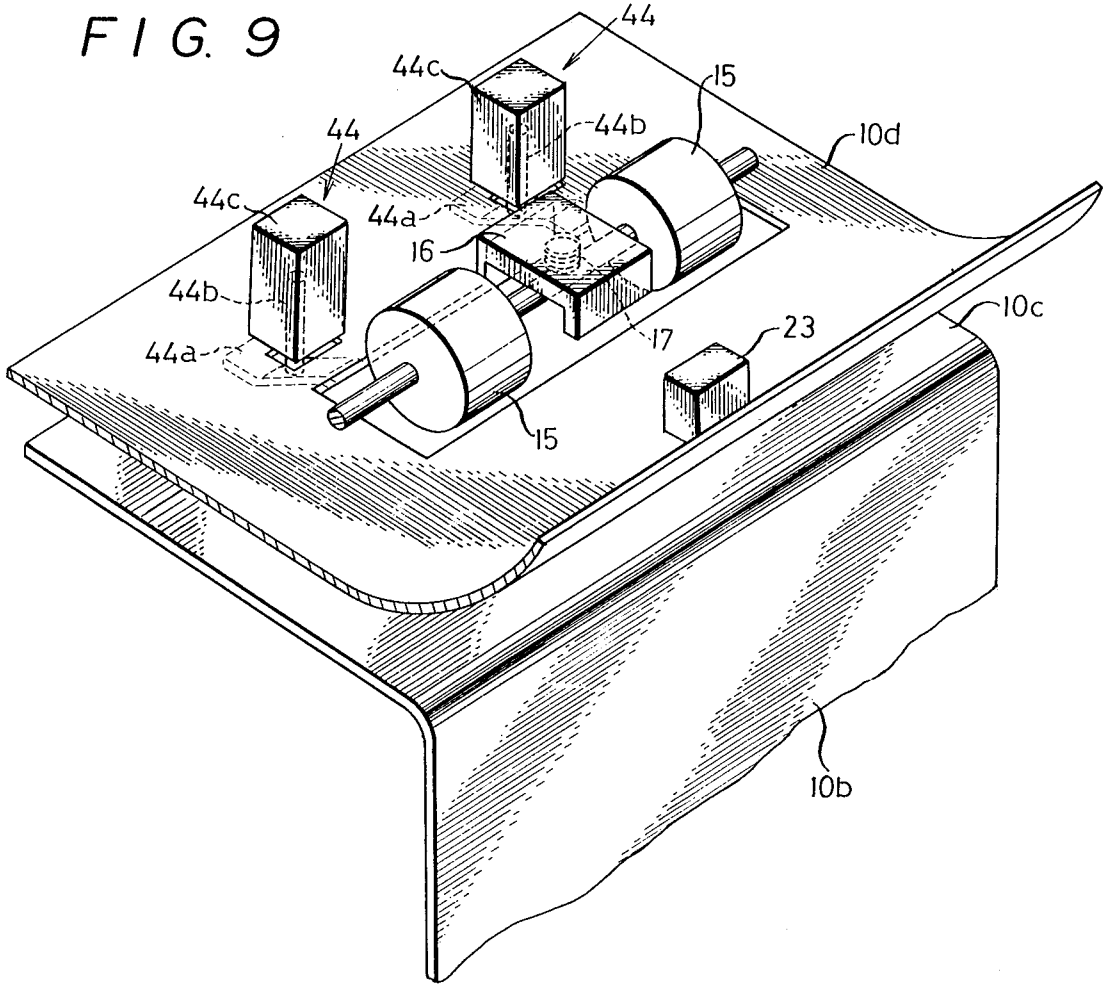
FIG. 9 is a perspective view of a typical recording paper pincher.

In the aforesaid embodiment, a recorded sheet pincher 44 is so provided that, while the aforesaid paper discharge rollers 15 and 21 are moving toward a receptacle 9 selected, the recorded sheet pincher 44 momentarily holds a leading edge of a recorded sheet P using the paper discharge rollers 15 and 21 themselves. Instead, as shown in FIG. 9, a separate recorded sheet pincher 44 rather than the paper discharge rollers 15 and 21 themselves may momentarily hold a leading edge of a recorded sheet P put into the paper discharge rollers 15 and 21. The separate recorded sheet pincher 44 consists of two elastic pinch pieces 44*a*, which are fixed to a lower face of the guide member 10*d* and can be easily deformed elastically, and two solenoids 44*c* which are fixed to an upper face of the guide member 10*d* and dislocate the elastic pinch pieces 44*a* downwards with actuators 44*b* through openings in the guide member 10*d*.

While the solenoids 44*c* are turned OFF, the aforesaid elastic pinch pieces 44*a* are so removed from the guide member 10*c* that they could not hamper the movement of recorded sheets P. If the solenoids 44*c* are turned ON, when a leading edge of recorded sheet P reaches in between the elastic pinch pieces 44*a* and the guide member 10*c* with the recorded sheet P pinched in between the aforesaid paper discharge rollers 15 and 21, the actuators 44*b* in the solenoids 44*c* dislocate the elastic pinch pieces 44*a* downwards so that the elastic pinch pieces 44*a* pinch the recorded sheet P with the guide member 10*c* while pressing the recorded sheet P down on the guide member 10*c*.

In addition, the aforesaid paper discharge rollers 15 and 21 can set their home position to receive recorded sheets P to one of receptacles 9, to match an existing location of a paper discharge port 3 in an electronic copying machine 2.

The above description is for a case where the invention is applied to an electronic copying machine, but the invention can be adaptable for sorting recorded sheets of paper from a printer and other image recording machines.

As seen from the above description concerning the embodiments, a sorter according to the invention can easily be adapted for any case where a recorded sheet discharge port 3 in an electronic copying machine 2 and other image recording machines changes its height. Furthermore, a sorter according to the invention can eliminate the need for a direction changeover member complex as seen in the prior art, thus realizing a simple configuration at large.

Figure 10:
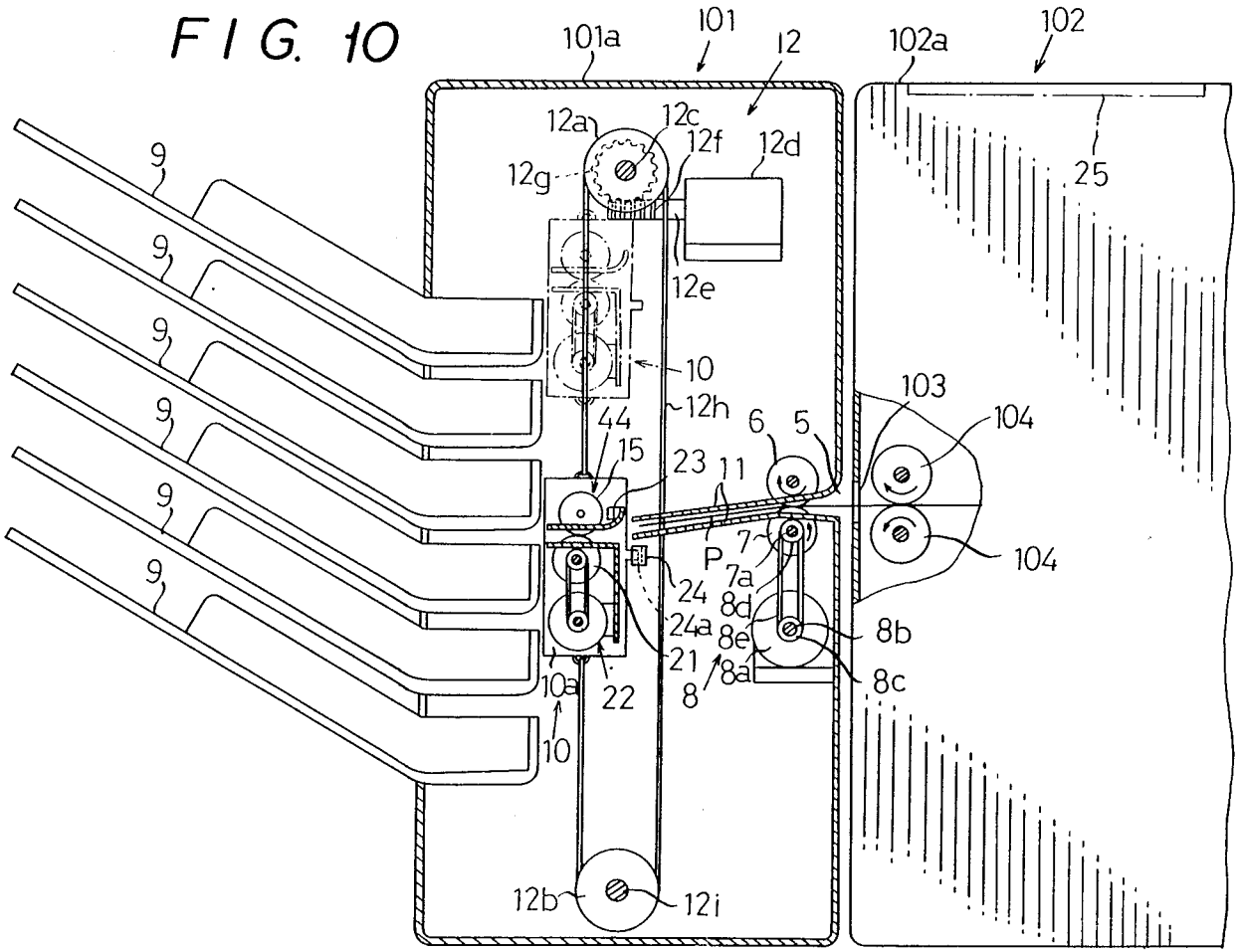
FIG. 10 is a side sectional view of a second embodiment.

FIG. 10 is another embodiment according to the invention. In the aforesaid embodiment shown in FIG. 1, the home position of the lift member 10 is set at the position corresponding to the bottom receptacle 9 of the six. In this embodiment, however, a home position is set at a position corresponding to a nearly central receptacle 9 (in the embodiment, a third receptacle from the bottom). Following the description of the configuration and operation of the embodiment.

Figure 11:
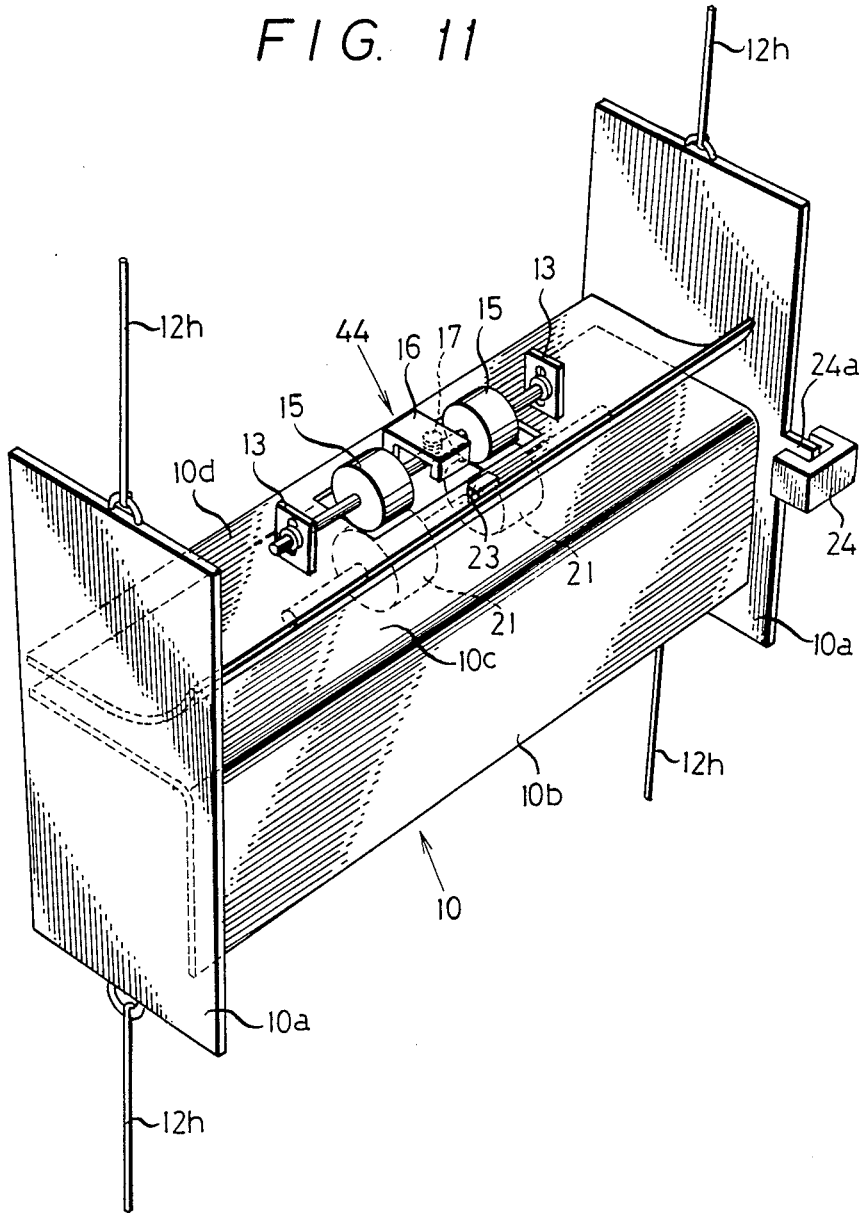
FIG. 11 is a perspective view of a typical lift member.

As shown in FIG. 10, in an electronic copying machine 102 according to the invention, a paper discharge port 103 and paper discharge rollers 104 are positioned upwardly compared with those in the electronic copying machine 2 shown in FIG. 1. Corresponding thereto, a paper receive port 5, paper receive rollers 6 and 7, and a paper receive roller driver 8 etc. in a sorter 101 are disposed upwardly compared with those in the sorter 1 shown in FIG. 1. A roller home position sensor 24, which detects if a lift member 10 comes to a substantially central home position shown by the full line in the figure, is disposed slightly under a paper guide member 11. A detect piece 24*a* provided on a side plate 10*a* of the lift member 10 is detected by the roller home position sensor 24, which is checking if paper discharge rollers 15 and 21 in the lift member 10 come to the approximately central home position. FIG. 11 is a perspective view which illustrates the roller position sensor 24 and the detect piece 24*a*.

The configuration of an operation indicating panel 25 in the electronic copying machine 102 is identical to that of the operation indicating panel 25 shown in FIG. 1, or that shown in FIG. 5. In addition, a block diagram of a control device for the sorter 101 is the same as that of the control device for the aforesaid embodiment shown in FIG. 6, except for stored information in a ROM in a microcomputer 143 in the embodiment.

Figure 12A:
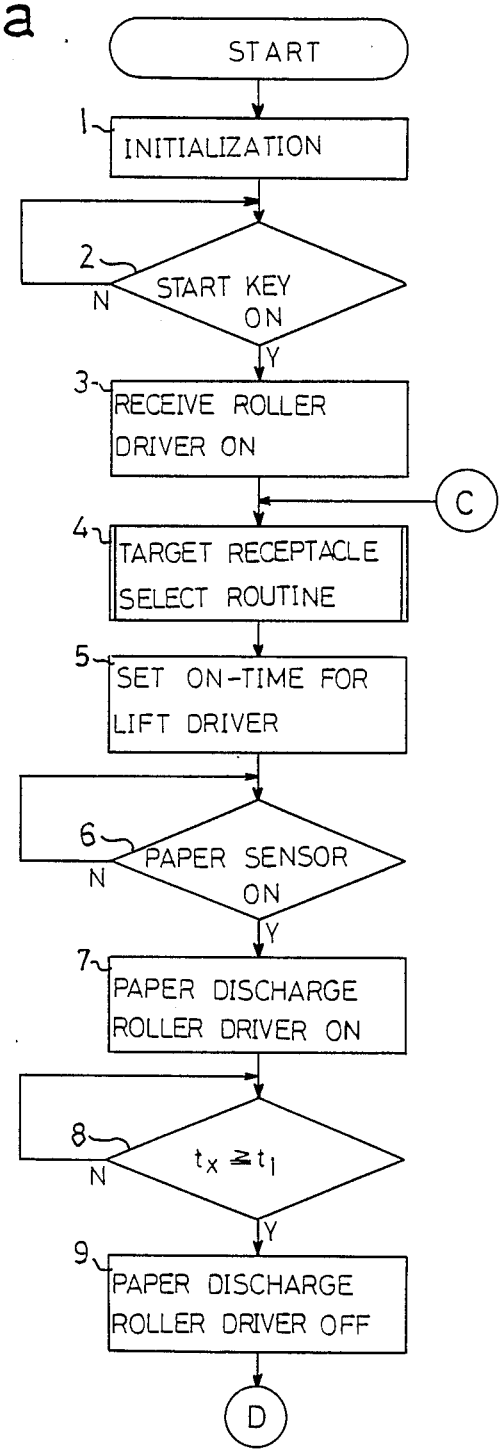
FIGS. 12*a*, 12*b*, 12*c*, 13*a* and 13*b* are control flow charts of the second embodiment.
Figure 12B:
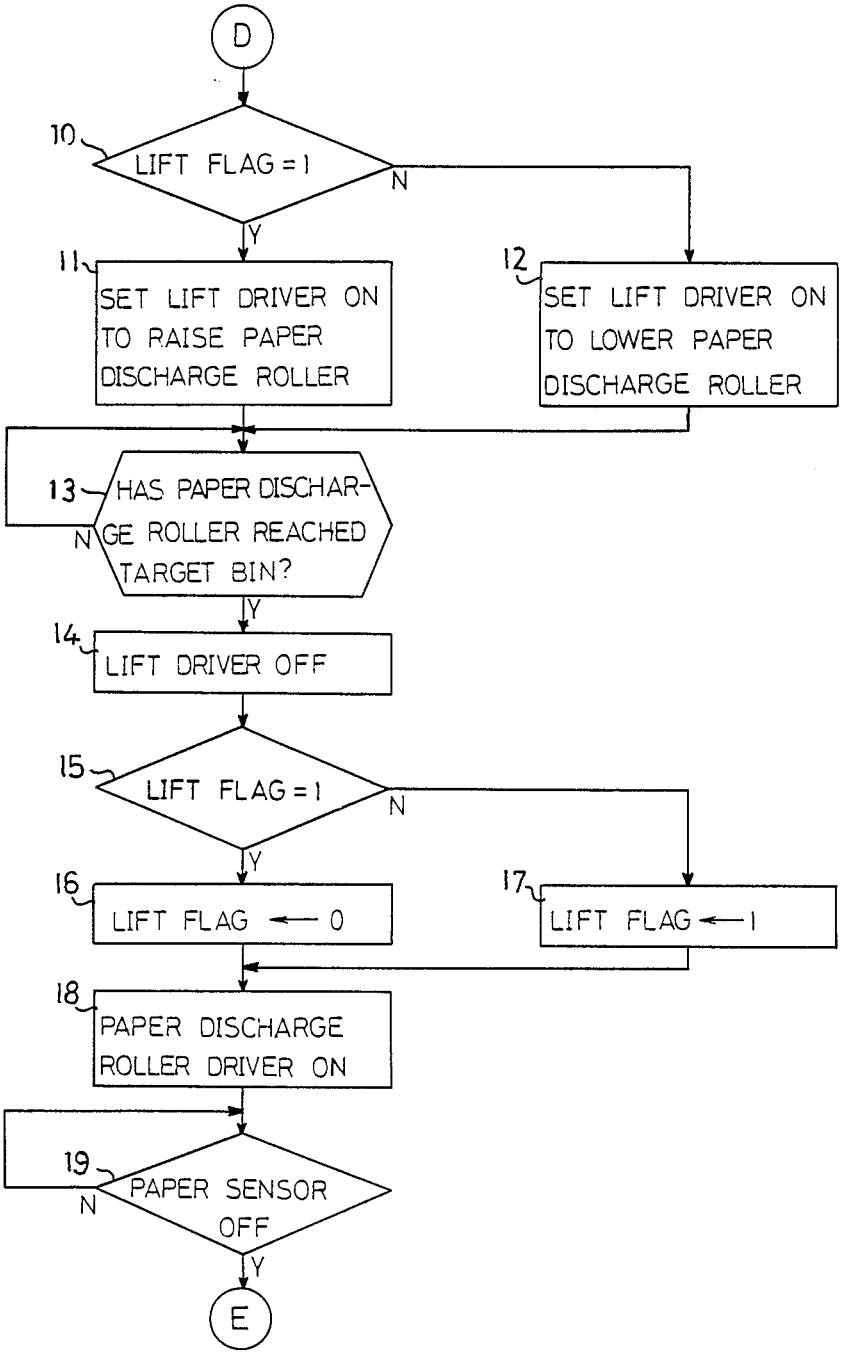
Figure 12C:
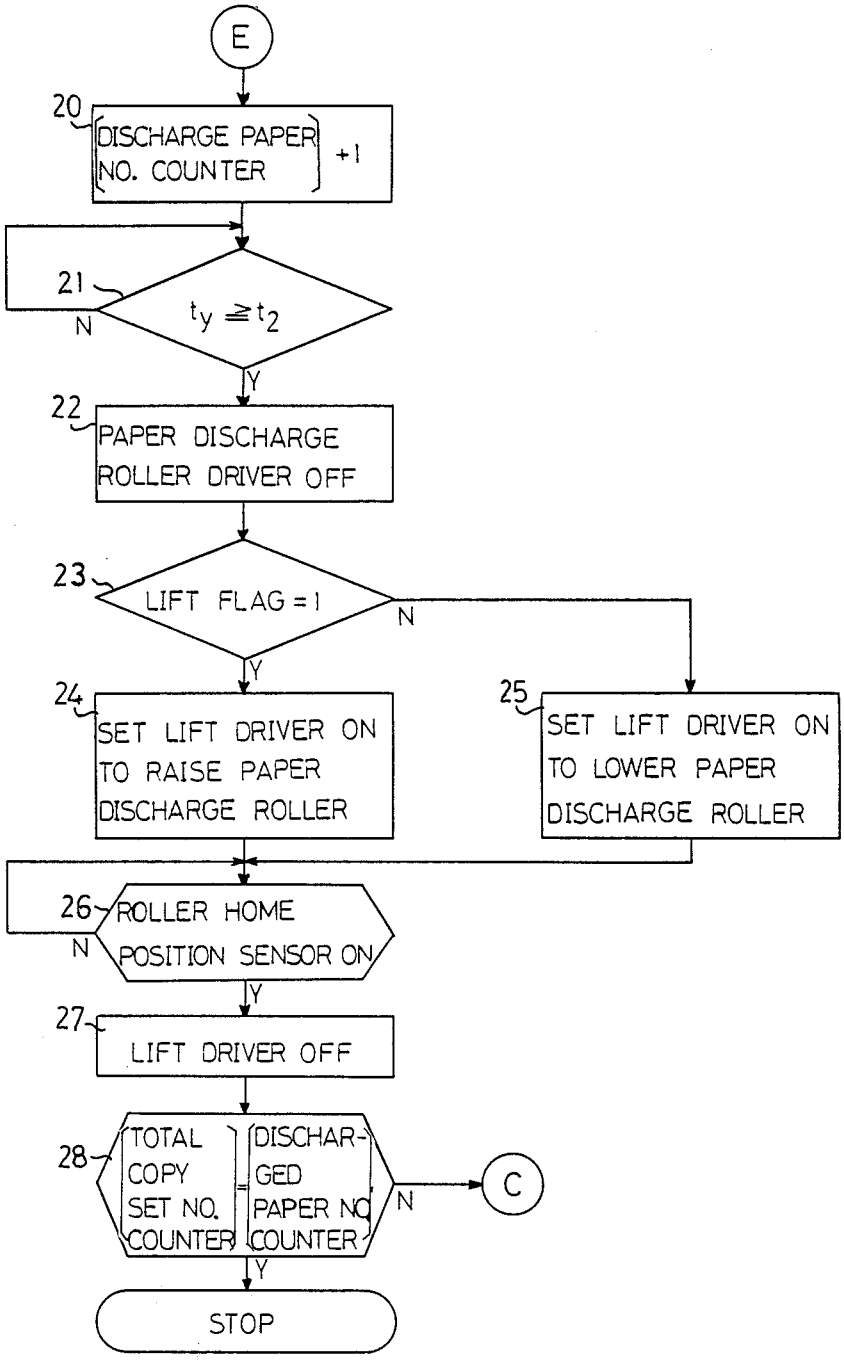
Figure 13A:
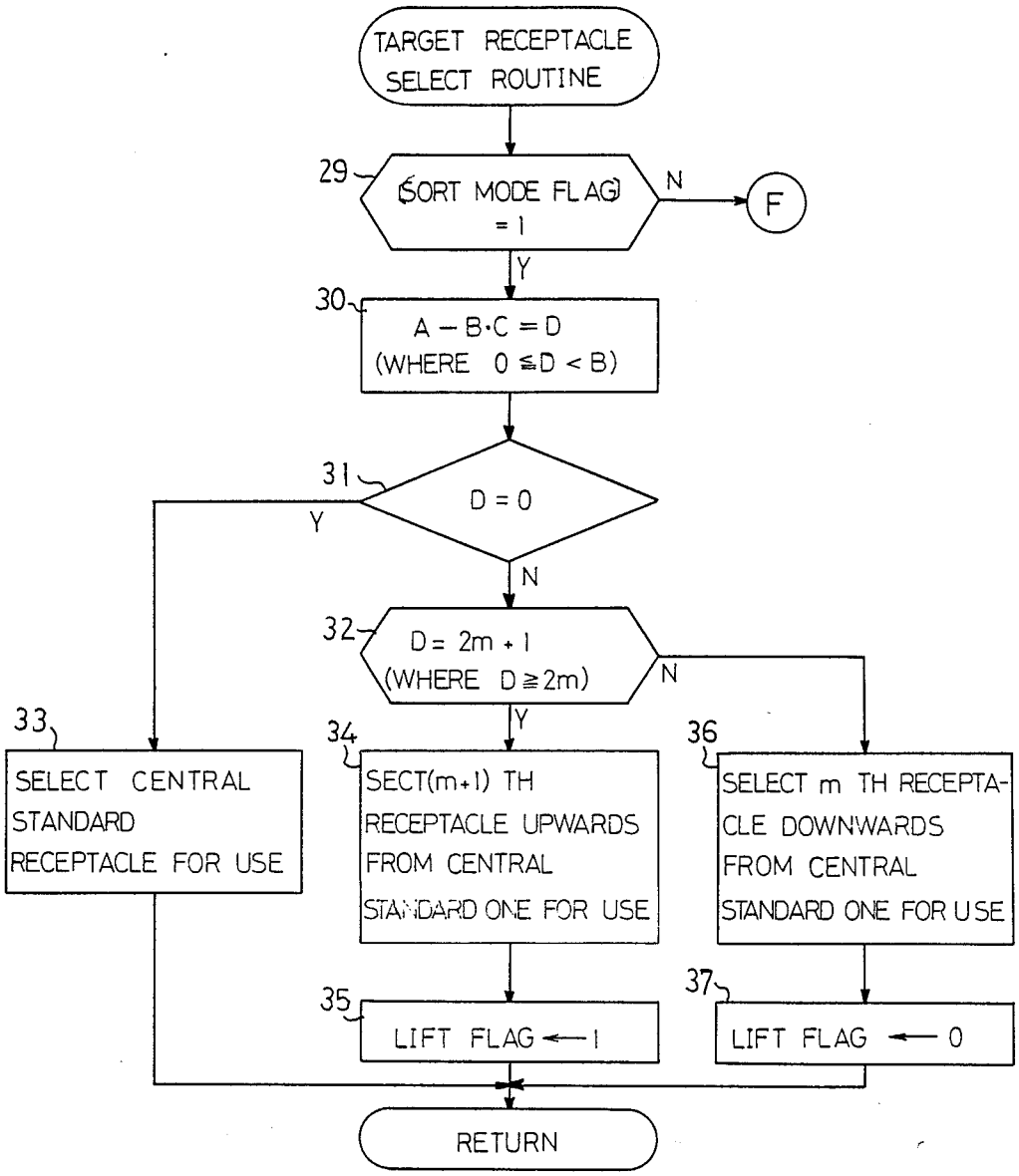
Figure 13B:
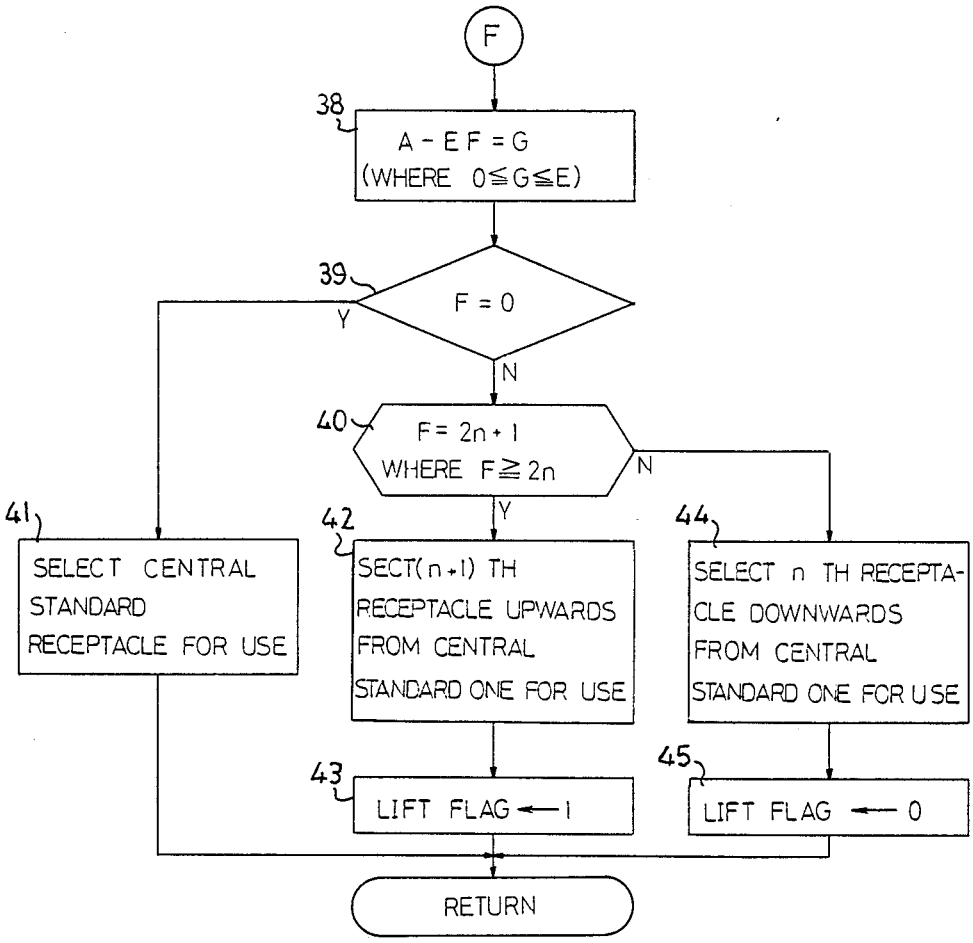

When the microcomputer 143 receives a signal showing that a power key 26 in FIG. 5 is turned ON, recorded sheets of paper are sorted according to a program shown by the flow charts in FIGS. 12*a*, 12*b*, 12*c*, 13*a* and 13*b*, which is incorporated in the ROM in the microcomputer 143. FIGS. 12*a*, 12*b* and 12*c* show a main routine of the flow and FIGS. 13*a* and 13*b* a subroutine of the flow.

In FIG. 12*a*, Step 1 to Step 8 are similar to those of the control flow in the aforesaid embodiment shown in FIGS. *7a* and *7b*. If Step 8 determines $t_x \geqq t_1$, Step 9 turns a paper discharge roller driver 22 OFF, and then Step 10 checks if lift flag=1 or not. If Step 10 determines lift flag=1, Step 11 turns a lift driver 12 ON to lift the paper discharge rollers 15 and 21, and proceeds to Step 13. If Step 10 determines that lift flag is not equal to 1, Step 12 turns the lift driver ON to lower the paper discharge rollers 15 and 21, and proceeds to Step 13.

Step 13 checks if the paper discharge rollers 15 and 21 have reached a receptacle 9 selected in the target receptacle select routine in the Step 4 or not, i.e. if the lift driver 12 has been kept ON for the ON-time set in the Step 5 or not.

If the aforesaid Step 13 determines that the paper discharge rollers 15 and 21 have reached the selected receptacle, Step 15 checks if lift flag=1 or not, after Step 14 turns the lift driver ON. If Step 15 determines lift flag=1, Step 16 makes lift flag 0. And, if Step 15 determines lift flag=0, Step 17 makes lift flag 1. And then, Step 18 turns ON the paper discharge driver 22 to discharge the recorded sheet P to the receptacle 9 using the paper discharge rollers 15 and 21.

Step 19 checks if a paper sensor 23 is turned OFF or not. If Step 19 determines that the paper sensor 23 is turned OFF, Step 20 adds "1" to a value of a discharged paper No. counter, and then Step 21 checks if $t_y \geqq t_2$ or not, where $t_y$ is an elapsed time from the instant when Step 19 determined that the paper sensor 23 was OFF, and $t_2$ is a time, from the instant when Step 19 determined that the paper sensor 23 was OFF, required for recorded sheet P discharged by the paper discharge rollers 15 and 21 to get out of the paper discharge rollers 15 and 21.

If the aforesaid Step 21 determines $t_y \geqq t_2$, Step 22 turns OFF the paper discharge roller driver 22, and then Step 23 checks if lift Flag=1 or not. If Step 23 determines lift flag=1, Step 24 turns ON the lift driver 12 to lift the paper discharge rollers 15 and 21, and then the flow goes to Step 26. If Step 23 determines that lift flag is not equal to 1, Step 25 turns ON the lift driver to lower the paper discharge rollers 15 and 21, and then the flow goes to Step 26.

Step 26 checks if the roller home position sensor 24 is turned ON or not. If Step 26 determines that the roller home position sensor 24 is turned ON, Step 27 turns OFF the lift driver 12 to have the paper discharge rollers standing by at the home position, and then Step 28 checks a value of total copy set No. counter=a value of discharged paper No. counter or not. If Step 28 determines that the value of total copy set No. counter is not equal to the value of discharged paper No. counter, the flow returns to Step 4. If Step 28 determines that the value of total copy set No. counter is equal to the value of discharged paper No. counter, a complete cycle of the main routine is over.

FIG. 13 shows the flow chart of the target receptacle select routine, the Step 4 in FIG. 12*a*. The operation procedure is as follows:

First, Step 29 checks if sort mode Flag=1 or not. If the Step 29 determines sort mode Flag=1, that is, the current mode is "sort mode", Step 30 finds C and D to satisfy $A-BC=D$ (where $0 \leqq D < B$), where the aforesaid A is a value of the discharged sheet No. counter, B is a value of the stacked receptacle No. counter, and C and D are zero or positive integers. Step 31 checks D=0 or not. If Step 31 determines that D is not equal to 0, Step 32 checks if D=2m+1 or not (where $D \geqq 2m$ and m is 0 or positive integers).

If the aforesaid Step 31 determines D=0, Step 33 selects a central reference receptacle 9 as a target receptacle 9 o return the flow to the main routine. If the aforesaid Step 32 determines pu D=2m+1 (where $D \geqq 2m$), Step 34 selects a (m+1) th receptacle 9 upward from the central reference receptacle 9 as a target receptacle 9, and Step 35 makes lift flag "1" to return the flow back to the main routine. If the aforesaid Step 32 determines that D is not equal to 2m+1 (where $D \geqq 2m$), Step 36 selects a m th receptacle 9 downward from the central reference receptacle 9 as a target receptacle 9, and Step 37 makes lift flag 0 to return back to the main routine.

If the aforesaid Step 29 determines that a value of sort mode flag is not equal to 1, that is, the current mode is "stack mode", Step 38 finds F and G to satisfy $A-EF=G$ (where $0 \leqq G \leqq E$), where E is a maximum number of recorded sheets P stacked on a receptacle 9, and F and G are zero or positive integers. Step 39 checks F=0 or not. If Step 39 determines that F is not 0, Step 40 checks if F=2n+1 or not (where $F \geqq 2n$, and n is 0 or positive integer).

If the aforesaid Step 39 determines F=0, Step 41 selects the central reference receptacle 9 as a target receptacle 9 to return the flow to the main routine. If the aforesaid Step 40 determines $F=2n+1$ (where $F \geqq 2n$), Step 42 selects a (n+1) th receptacle 9 upward from the central reference receptacle 9 as a target receptacle 9, and Step 43 makes lift flag "1" to return back the flow to the main routine. If the aforesaid Step 40 determines that F is not equal to 2n+1 (where $F \geqq 2n$), Step 44 selects a n th receptacle 9 downward from the central reference receptacle 9 as a target receptacle 9, and Step 45 makes lift flag "0" to return the flow to the main routine.

In the sorter 101 shown in FIG. 10, since the lift member 10 or the discharge rollers 15 and 21 stand by at the substantially central portion of a plurality of vertically arranged receptacles 9 (in the embodiment, six receptacles), only nearly half a distance from the top to the bottom receptacle 9 suffices for the paper discharge rollers 15 and 21 to move up or down to sort a recorded sheet P. Therefore, vertical movements of recorded sheets P are reduced, resulting in a high speed sorting of recorded sheets.

In the embodiments shown in FIGS. 1 and 10, the home positions of the lift member 10 are set to the respective positions matching the bottom and the approximately central receptacle. The home position of the lift member 10, however, can be set to the other position corresponding to an arbitrary receptacle rather than the aforesaid receptacles, for example, a position corresponding to a top receptacle shown in one-dot chain lines in FIGS. 1 and 10. Flow charts in FIGS. 14 and 15 show an example of sorting operation in the case that a home position of the lift member 10, i.e. of the paper discharge rollers 15 and 21 is set to the top receptacle 9. A program shown by these flow charts is implemented by the microcomputer 243 in FIG. 6.

Figure 14A:
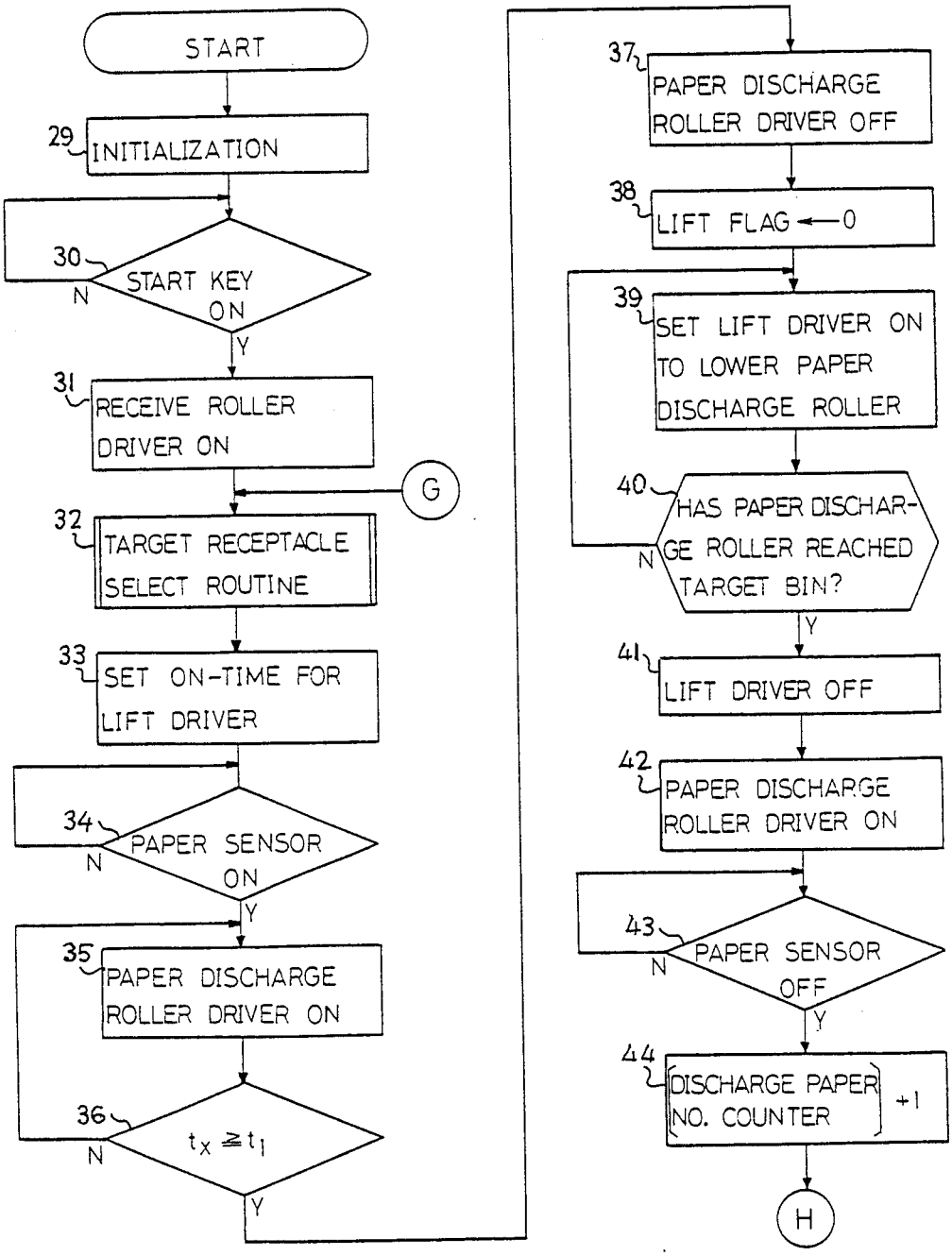
FIGS. 14*a*, 14*b* and 15 are flow charts of another control system.
Figure 14B:
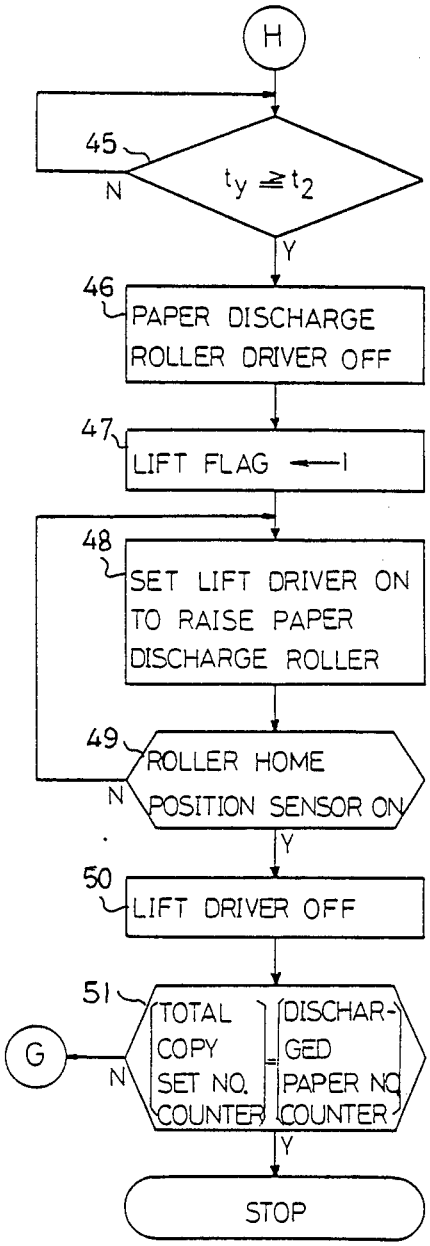
Figure 15:
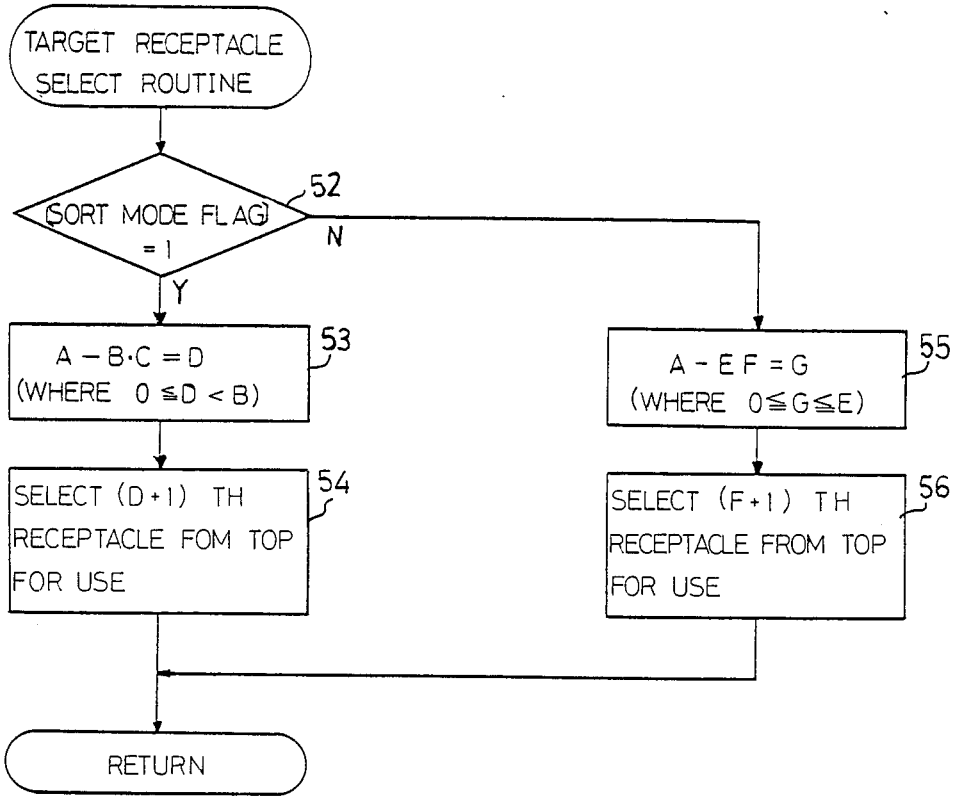

Flow from Step 29 to Step 36 in FIG. 14*a* is similar to the flow from Step 1 to Step 8 in FIGS. 7*a* and 12*a*.

If the aforesaid Step 36 determines $t_x \geqq t_1$, Step 37 turns OFF the paper discharge driver 22, and Step 38 makes lift flag "0", and Step 39 turns ON the lift driver 12 to lower (move to the target receptacle 9) the paper discharge rollers 15 and 21. Then, Step 40 checks if the paper discharge rollers 15 and 21 have reached the receptacle 9 selected by the target receptacle select routine, Step 32 or not, i.e. if the lift driver 12 has been kept ON for the ON-time for the lift driver 12 set in Step 33 or not.

If the aforesaid Step 40 determines that the paper discharge rollers 15 and 21 have not reached the selected receptacle 9, the flow turns back to Step 39 to hold the lift driver 12 ON. If the Step 40 determines that the paper discharge rollers 15 and 21 have reached the selected receptacle 9, Step 41 turns the lift driver 12 OFF, and Step 42 turns ON the paper discharge roller driver 22, and then Step 43 checks if the paper sensor 23 is OFF or not.

If the aforesaid Step 43 determines that the paper sensor 23 is OFF, i.e. if the paper sensor 23 detects a trailing edge of recorded sheet P, Step 44 adds 1 to a value of the discharged paper No. counter, and then Step 45 checks if $t_y \geqq t_2$. The $t_y$ is an elapsed time from the instant when Step 43 determined the the paper sensor 23 was turned OFF, and the $t_2$ is a time, from the instant when Step 43 determined that the paper sensor 23 was turned OFF, required to recorded sheet P discharged by the paper discharge rollers 15 and 21 to get out of the paper discharge rollers 15 and 21.

If the aforesaid Step 45 determines $t_y \geqq t_2$, Step 46 turns the paper discharge roller driver 22 OFF, Step 47 makes lift flag "1", and then Step 48 turns the lift driver 12 ON to lift (return to the home position) the paper discharge rollers 15 and 21. Next, Step 49 checks if the roller home position sensor (in this case, located at a position matching the top receptacle) is ON or not. If Step 49 determines that the roller home position sensor 24 is not ON, the flow goes back to Step 48 to keep the lift driver 12 ON.

If the aforesaid Step 49 determines that the roller home position sensor 24 is ON, Step 50 turns OFF the lift driver to keep the paper discharge rollers 15 and 21 at the home position, and then Step 51 checks if a value of total copy set No. counter=a value of discharged paper No. counter or not. If Step 51 determines a value of total copy set No. counter is not equal to a value of discharged paper No. counter, the flow returns back to Step 32. If Step 51 determines a value of total copy set No. counter is equal to a value of discharged paper No. counter, a complete cycle of this operation is over.

FIG. 15 illustrates a target receptacle select routine, Step 32 in FIG. 14*a*. Step 52 checks if sort mode Flag=1 or not. If Step 52 determines that a value of sort mode flag is 1, i.e., that the current mode is "sort mode", Step 53 finds C and D to satisfy $A-BC=D$ (where $0 \leqq D < B$), where A is a value of discharged paper counter, B is a value of target receptacle No. counter, and C and D are 0 or positive integers. Using a value of D found in Step 53, Step 54 selects a (D+1) th receptacle 9 from the top to a target receptacle 9 to return to the main routine.

If the aforesaid Step 52 determines that a value of sort mode flag is not equal to 1, Step 55 finds F and G to satisfy $A-EF=G$ (where $0 \leqq G \leqq E$), where E is a maximum number of recorded sheets P stacked on a receptacle 9, and F and G are 0 or positive integers. Using a value of F solved in Step 55, Step 56 selects a (F+1) th receptacle from the bottom as a target receptacle 9 to return to the main routine.

The above description presents two recorded sheet pinch means which momentarily hold recorded sheets sent to the lift member 10: (1) A method shown in FIG. 2, in which the paper discharge rollers 15 and 21 are rotated for a certain short time and then brought to a stop. (2) Another method shown in FIG. 9, in which solenoids 44*c* and elastic pinch pieces 44*a* are used. Methods shown in FIGS. 16 to 20 rather than the aforesaid may be employed.

Figure 16:
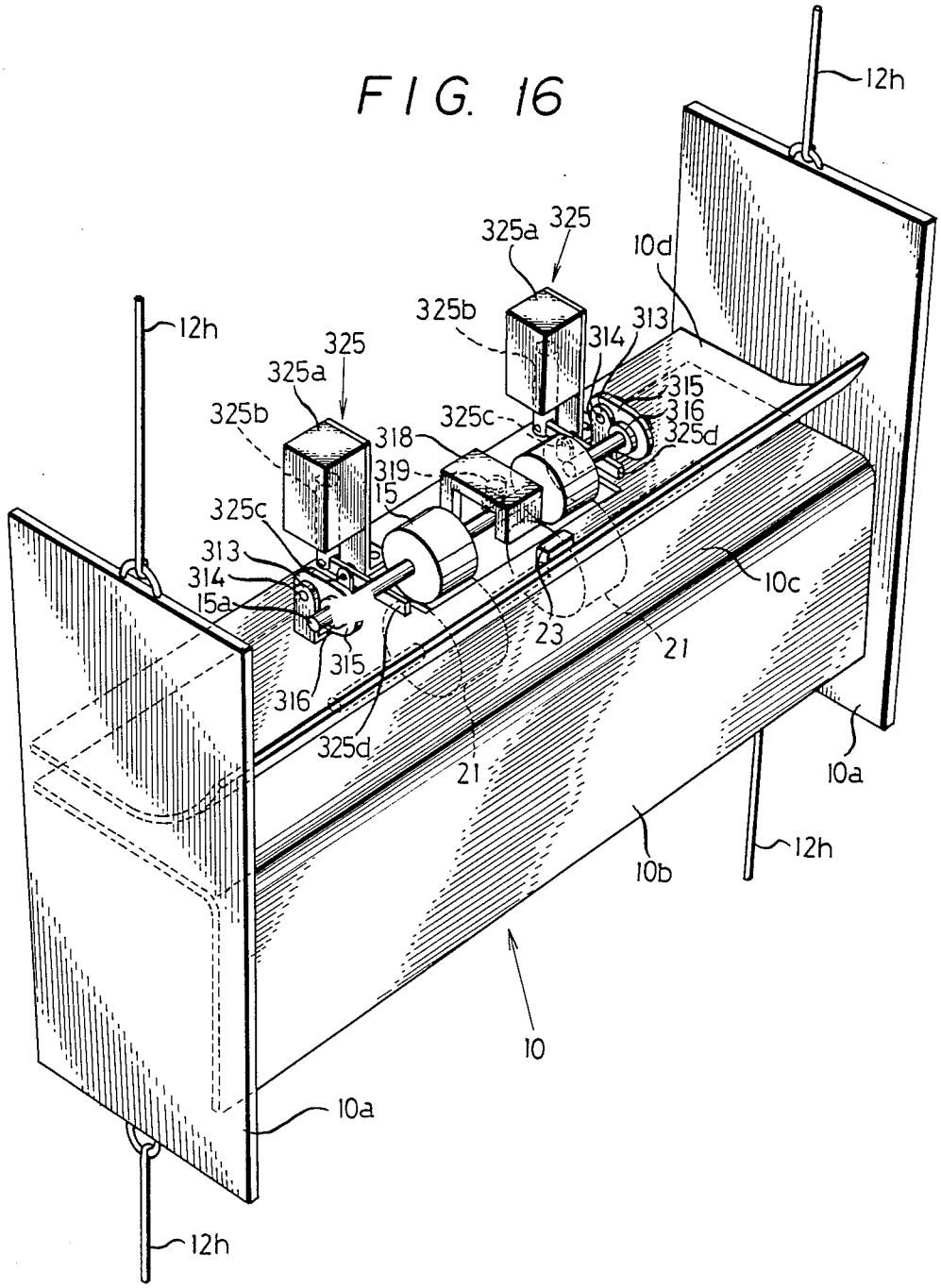
FIG. 16 is a perspective view of another typical recording paper pincher.
Figure 17:
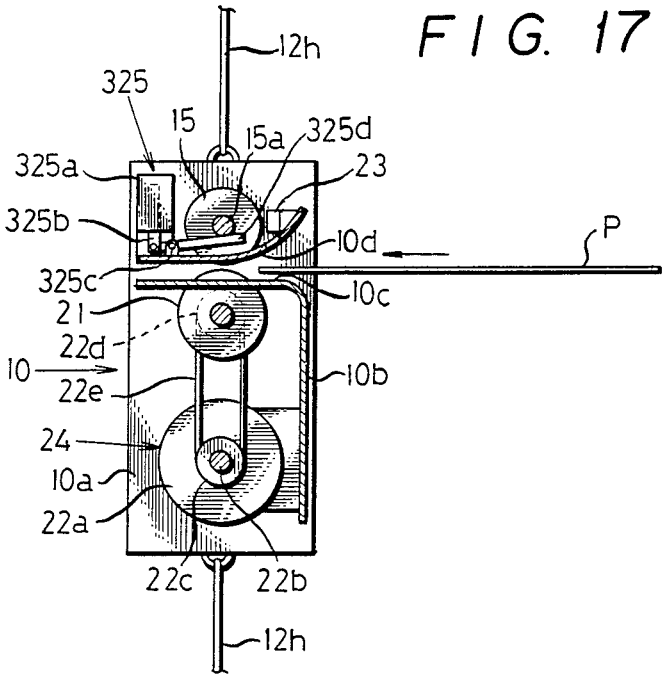
FIG. 17 is a side sectional view of the recording paper pincher in FIG. 16.
Figure 18:
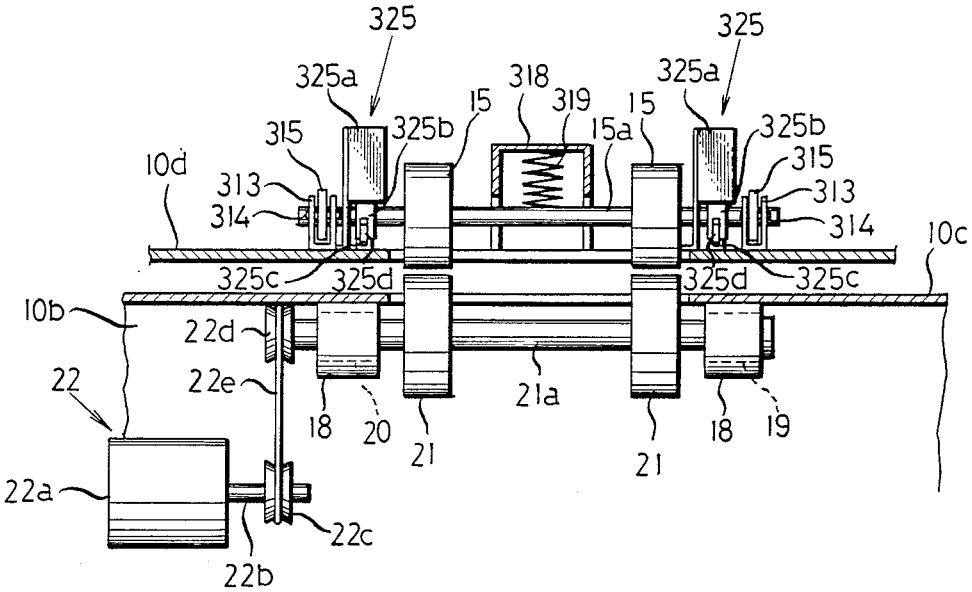
FIG. 18 is a frontal sectional view of the recording paper pincher in FIG. 16.

As shown in FIGS. 16 and 18, two hold members 313 extend out of a guide member 10*d*. Support members 315 are rotatably supported by support pins 314 fixed to these hold members 313, and a revolving shaft 15*a* of the paper discharge rollers 15 is supported by bearings 316 fixed to the support members 315, so that the paper discharge rollers can be moved substantially vertically. In addition, a separate hold member 318, also projected out of the aforesaid guide member 10*d* holds a spring 319 to press down the revolving shaft 15*a* of the paper discharge rollers 15.

On the aforesaid guide member 10*d* as shown in FIG. 16, paper discharge roller separators 325 are provided to separate the two pairs of paper discharge rollers 15 and 21 by momentarily pressing up the paper discharge rollers 15. Each of the paper discharge roller separators 325 consists of a solenoid 325*a* fixed to the guide member 10*d*, an actuator 325*b* energized by the solenoid 325*a*, and a press up lever 325*d* pin-jointed to the actuator 325*b* at one end thereof, rotatably supported by the support member 325*c* fixed to the guide member 10*d* at the middle portion and locating just below the revolving shaft 15*a* of the paper discharge rollers 15 at the other rotating end. When the aforesaid solenoids 325*a* are turned ON, the actuators 325*b* go down to rotate the press up levers 325*d*, which press up the paper discharge rollers 15 against an expansion force of the spring 319 to separate the two pairs of paper discharge rollers 15 and 21 with each other. When the aforesaid solenoids 325*a* are turned OFF, the paper discharge rollers 15 are pressed down by the expansion force of the spring 319, resulting in the two pairs of paper discharge rollers 15 and 21 being brought into elastic pressure contact with each other.

For a while from the instant when the paper sensor 23 detects a leading edge of recorded sheet P, the paper discharge roller separators 325 are turned ON to separate paired paper discharge rollers 15 and 21 from each other so that a leading edge of recorded sheet P sent by the receive rollers 6 and 7 can pass between paired paper discharge rollers 15 and 21. The paper discharge roller driver 325 is turned OFF to elastically force down the paper discharge rollers 15 by the spring 319 so as to pinch the leading edge of recorded sheet P between the paired paper discharge rollers 15 and 21.

Figure 19:
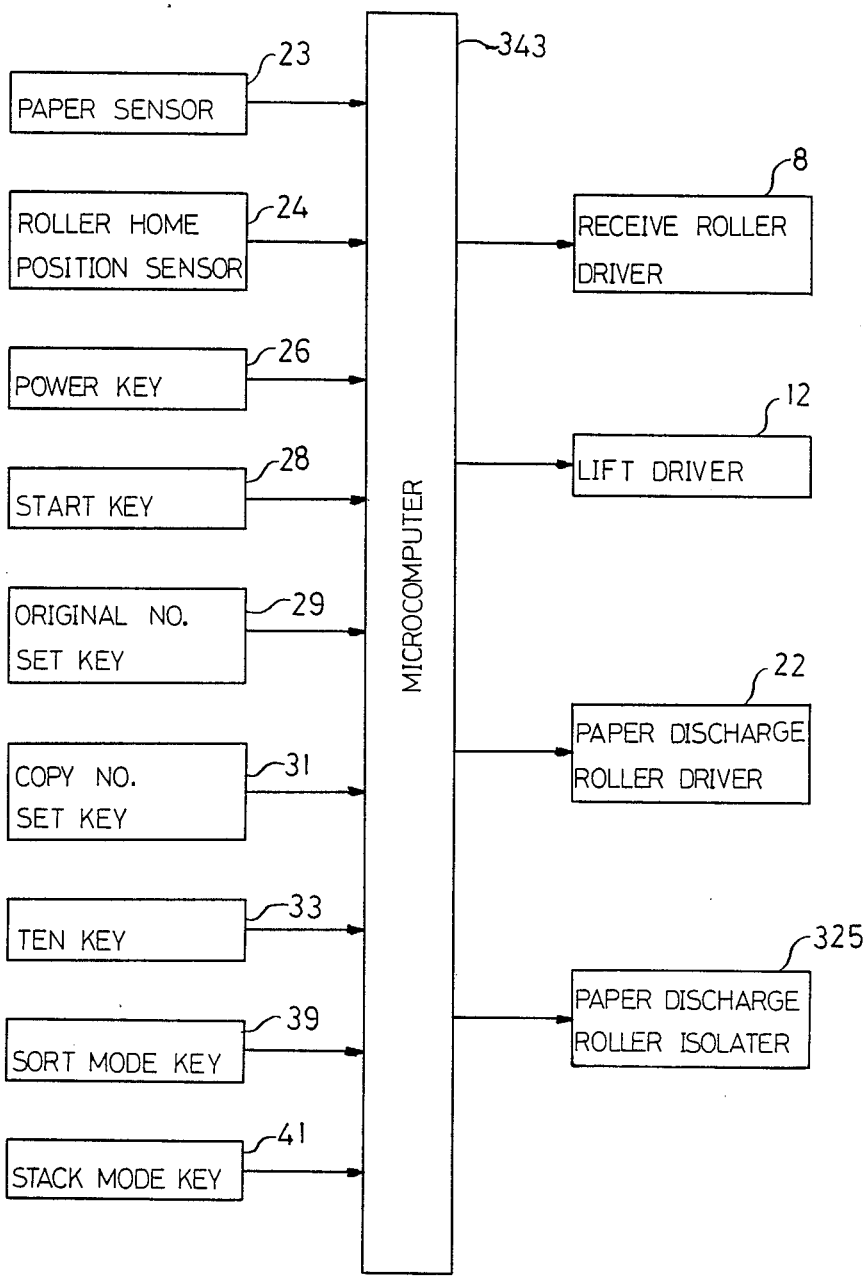
FIG. 19 is a block diagram of a sorter control device using the recording paper pincher in FIG. 16.
Figure 20A:
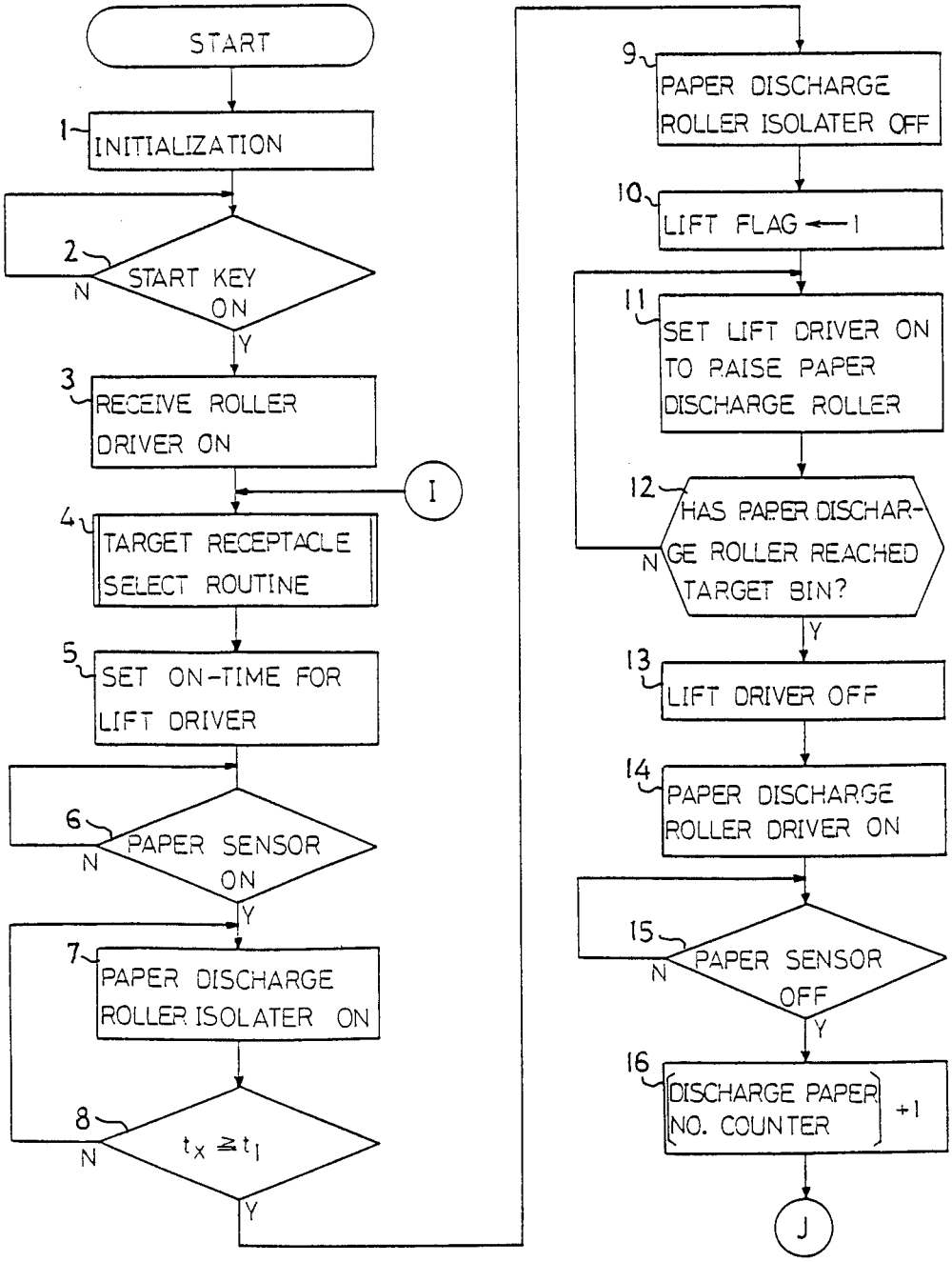
FIGS. 20*a* and 20*b* are control flow charts of the control device in FIG. 19.
Figure 20B:
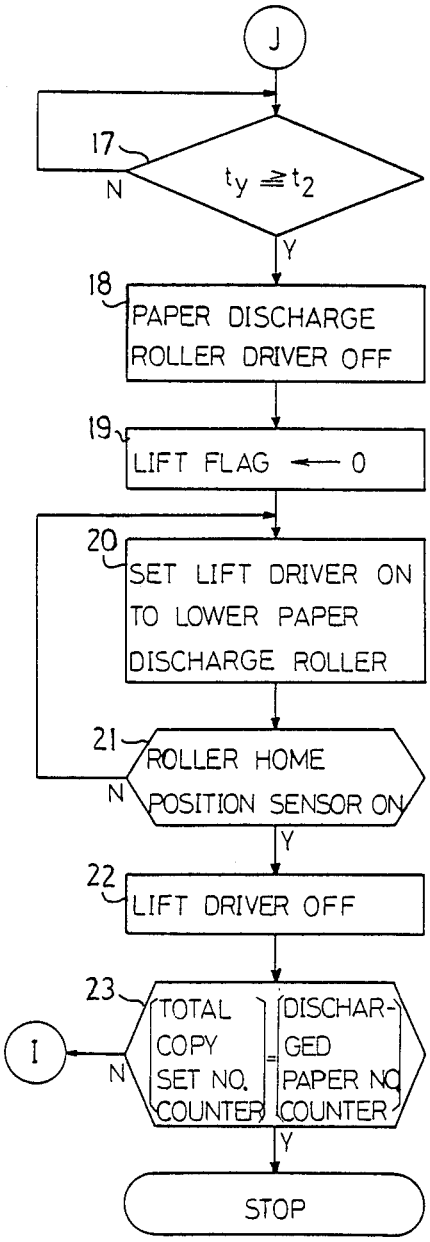

FIG. 19 shows a control device for a sorter using the recorded paper pincher. The control device is different from the aforesaid control device shown in FIG. 6 in that paper discharge roller separators 325 are connected to an output port in a microcomputer 343. The microcomputer 343 executes operational control according to flow charts in FIGS. 20*a* and 20*b*. The flow charts in FIGS. 20*a* and 20*b* are essentially the same as that in FIGS. 7*a* and 7*b*, excepting that $t_1$ in Step 8 is set to a time, from the instant when the paper discharge roller separators 325 are turned ON, required for the paper discharge rollers 15 and 21 to pinch the leading edge of recorded sheet P, and that in Step 9 the paper discharge roller separators 325 are tuned OFF rather than the paper discharge roller driver 22. Flow charts for a target receptacle select routine in Step 4 in FIG. 20*a* can be the same as that in FIG. 8.

Figure 21:
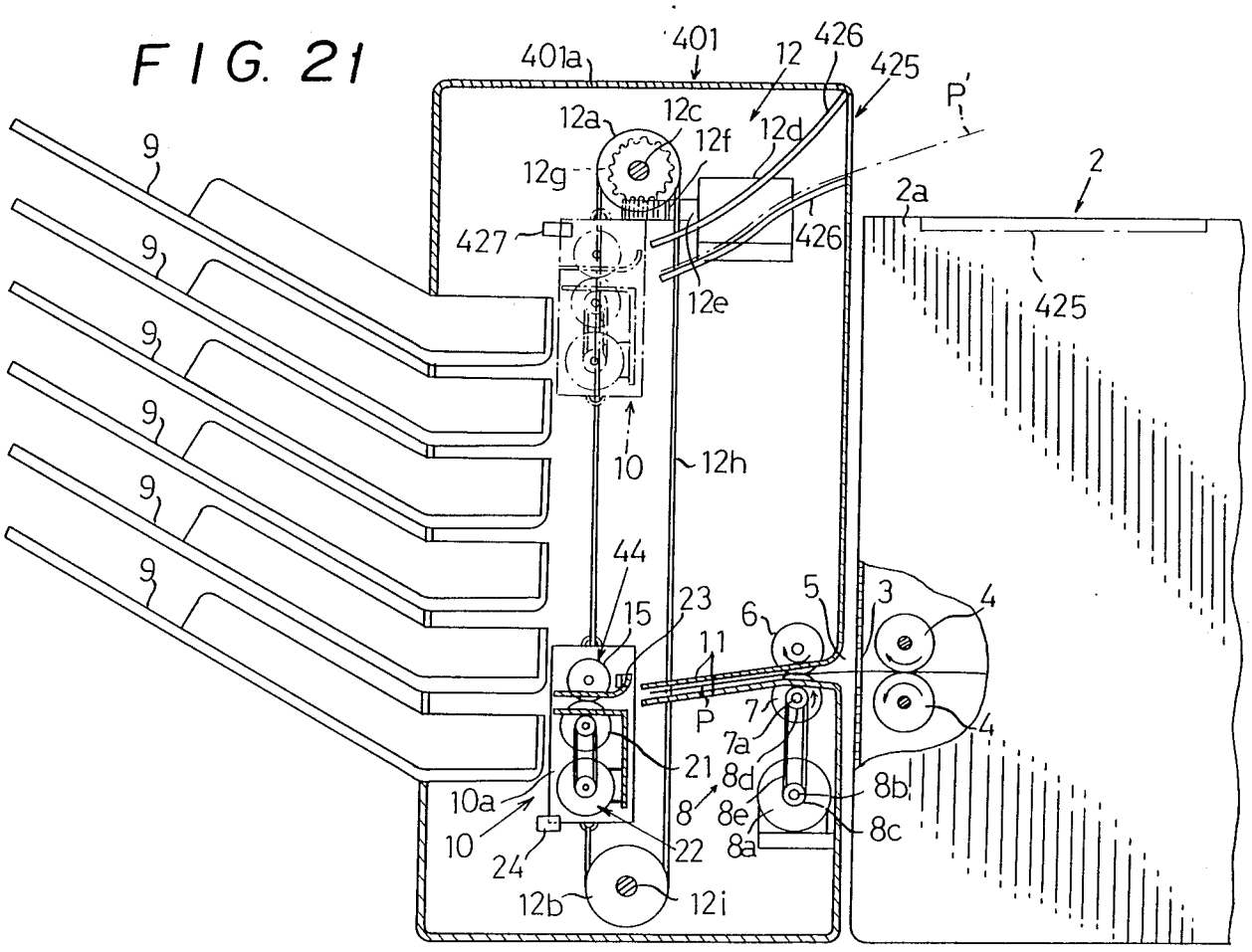
FIG. 21 is a side sectional view of a third embodiment.

FIG. 21 shows a further separate embodiment according to the invention. The embodiment is different from the aforesaid embodiments in that hand insert port 425 permitting a recorded sheet P' to be manually inserted is provided on an upper right side face of an outer casing 401*a* of a sorter 401.

When a hand insert sort mode is set to sort recorded sheets P' manually inserted from the paper hand insert port 425 onto receptacles 9, paper discharge rollers 15 and 21 are disposed at the top (hand insert paper roller home position). A hand insert paper guide member 426 is provided to guide recorded sheet P' inserted from the paper hand insert port 425 to the paper discharge rollers 15 and 21 deployed at the hand insert paper roller home position, in the aforesaid hand insert sort mode. A hand insert paper roller home position sensor 427 of photosensor type, is provided to determine if the aforesaid paper discharge rollers 15 and 21 stand by at the hand insert paper roller home position or not by detecting a lift member 10.

In the aforesaid hand insert sort mode, a recorded sheet P' inserted manually from the paper hand insert port 425 is sent in between the paired paper discharge rollers 15 and 21 to be pinched thereby. Then, the lift member 10 lowers to deploy the paper discharge rollers 15 and 21 at a position matching the selected receptacle 9, the paper discharge rollers 15 and 21 rotate to discharge recorded sheet P' to the receptacle 9, and then the lift member 10 goes up to return back the paper discharge rollers 15 and 21 to the hand insert paper roller home position.

Figure 22:
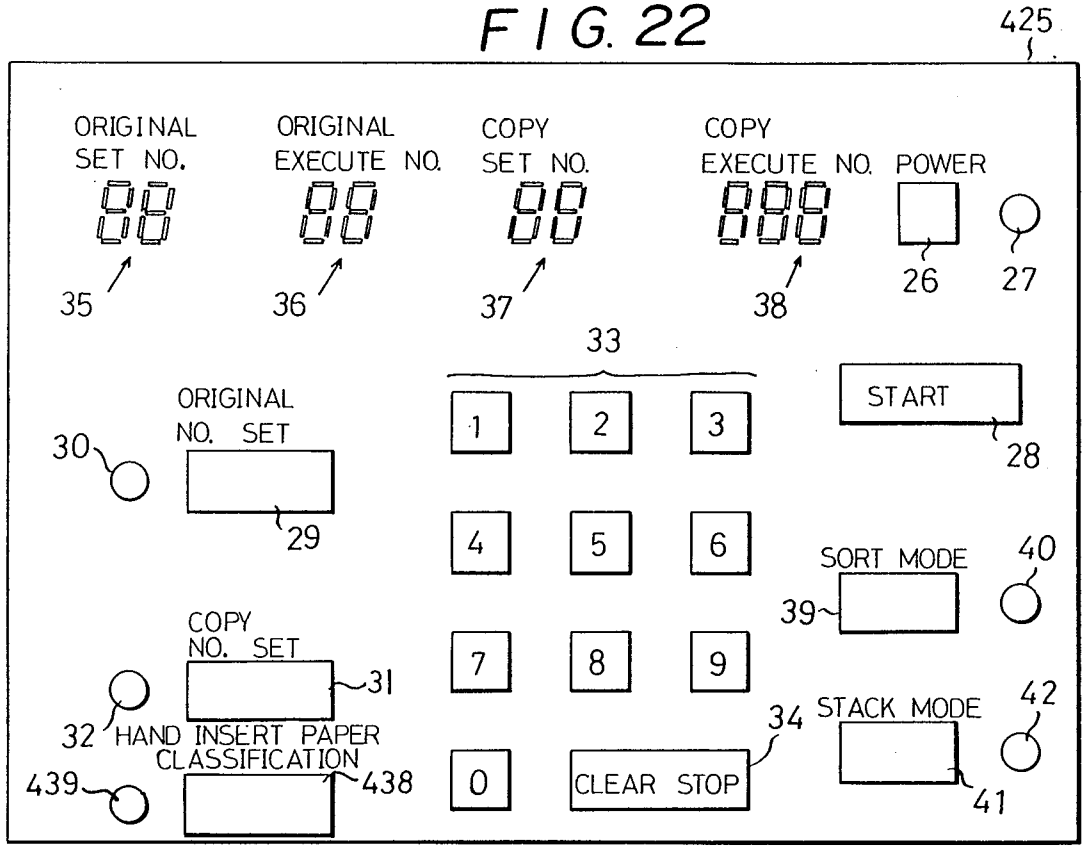
FIG. 22 is a plan view of an operation indicating panel of the third embodiment.

In order to set the hand insert sort mode, as shown in FIG. 22, on an operation indicating panel 425 on an outer casing 2*a* of an electronic copying machine 2 in FIG. 21, a hand insert sort mode indicator 439 is provided to display whether a hand insert sort mode key 438 and the hand insert sort mode are set or not. The other keys and indicators are identical to those on the panel 25 in FIG. 5.

Figure 23:
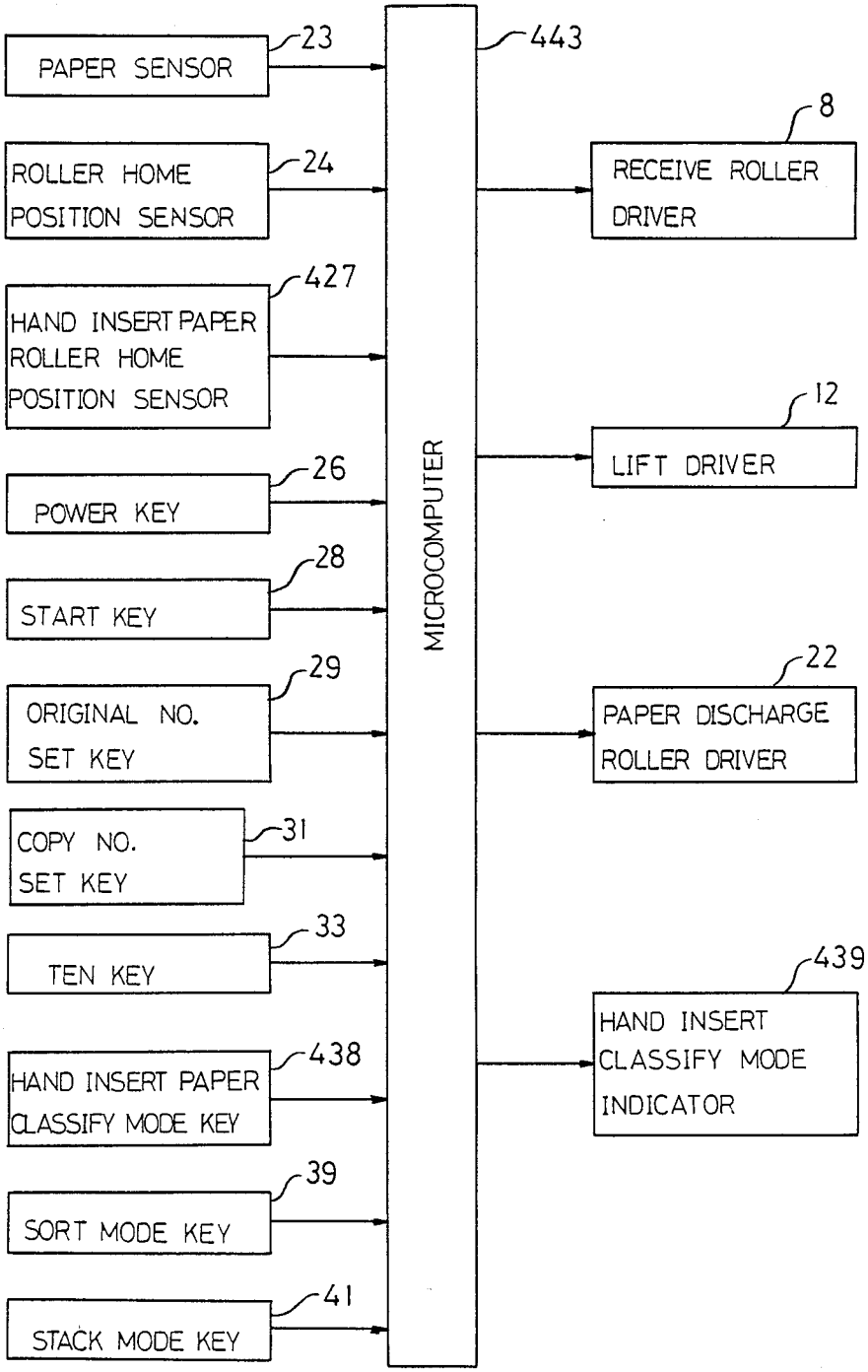
FIG. 23 is a block diagram of a control device of the third embodiment.

FIG. 23 shows a control device for the sorter 401 according to the invention. The difference from the aforesaid control device in FIG. 6 is that the hand insert paper roller home position sensor 427 and the hand insert sort mode key 438 are connected to an input port in a computer 443, and the hand insert sort mode indicator 439 is connected to an output port thereof. Additionally, values of a hand insert paper discharge counter and a hand insert sort flag are stored in RAM in the microcomputer 443. The hand insert sort mode flag is made "1" when the hand insert sort mode key 438 is turned ON.

Figure 24A:
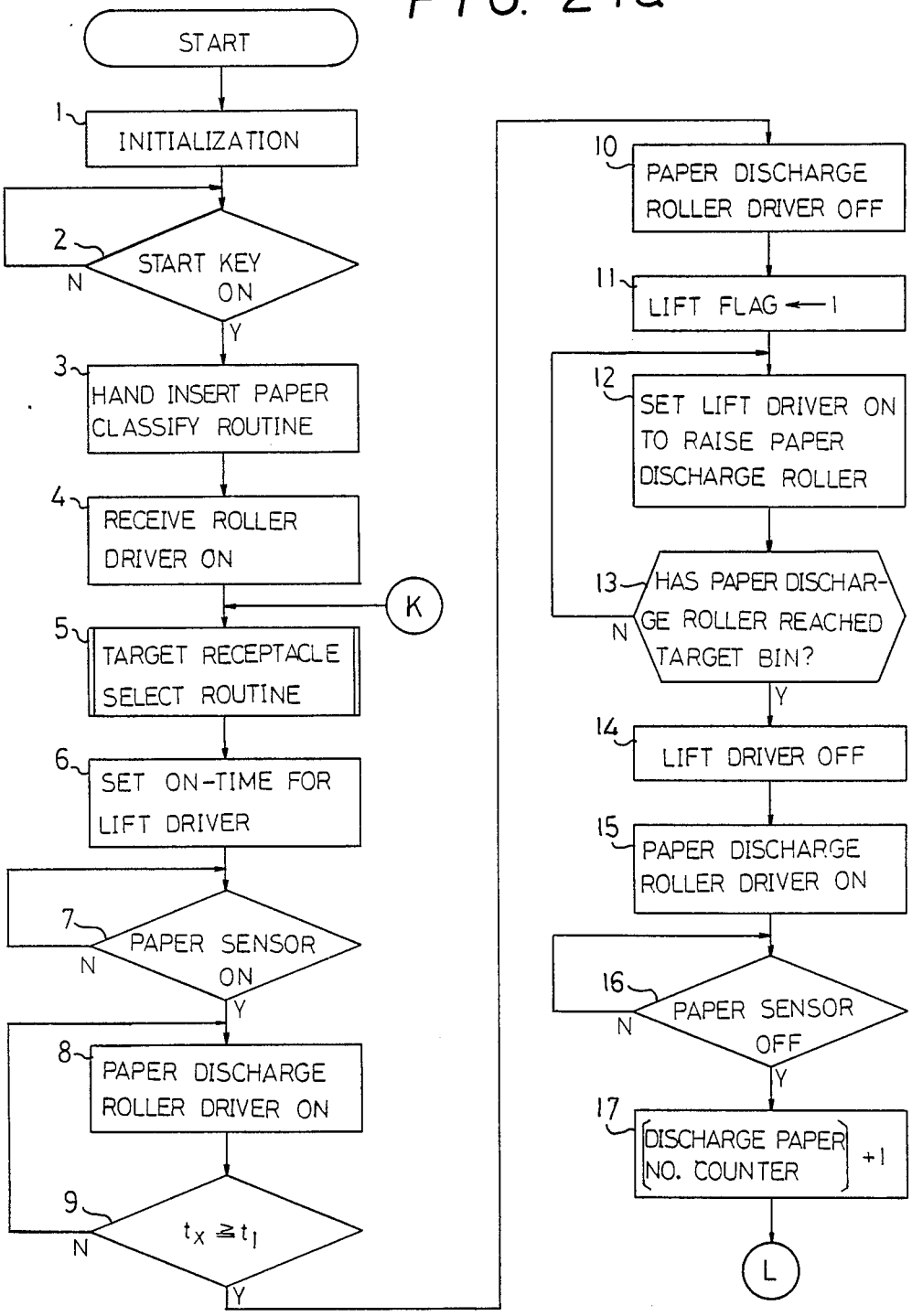
FIGS. 24*a*, 24*b*, 25*a*, 25*b* and 26 are control flow charts of the control device in FIG. 23.
Figure 24B:
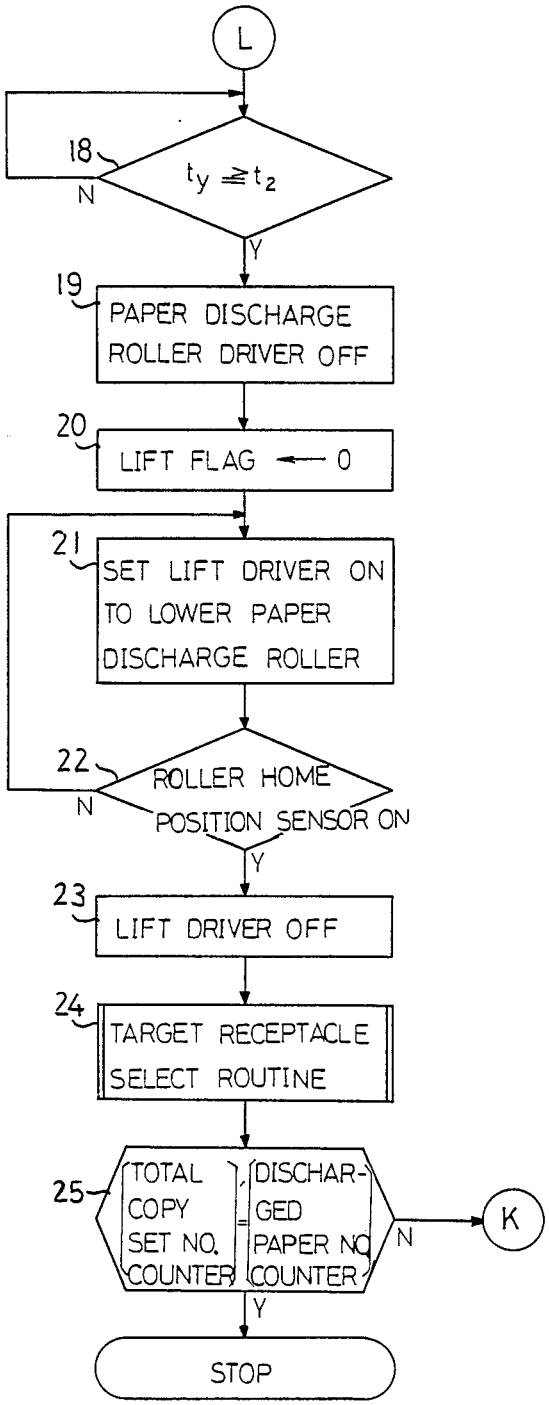

FIGS. 24*a* to 26 show a typical operation of a sorter 401 according to the invention. Flow charts shown in FIGS. 24*a* and 24*b* are basically similar to those shown in FIGS. 7*a* and 7*b*, excepting that a receive roller driver 8 is turned ON in Step 4 through hand insert sort routine, Step 3 and that Step 25 checks if a value of total copy set No. counter = a value of discharged paper No. counter or not through the hand insert sort routine, Step 24. Target receptacle select routine in Step 5 can be the same as that shown in FIG. 8.

Figure 25A:
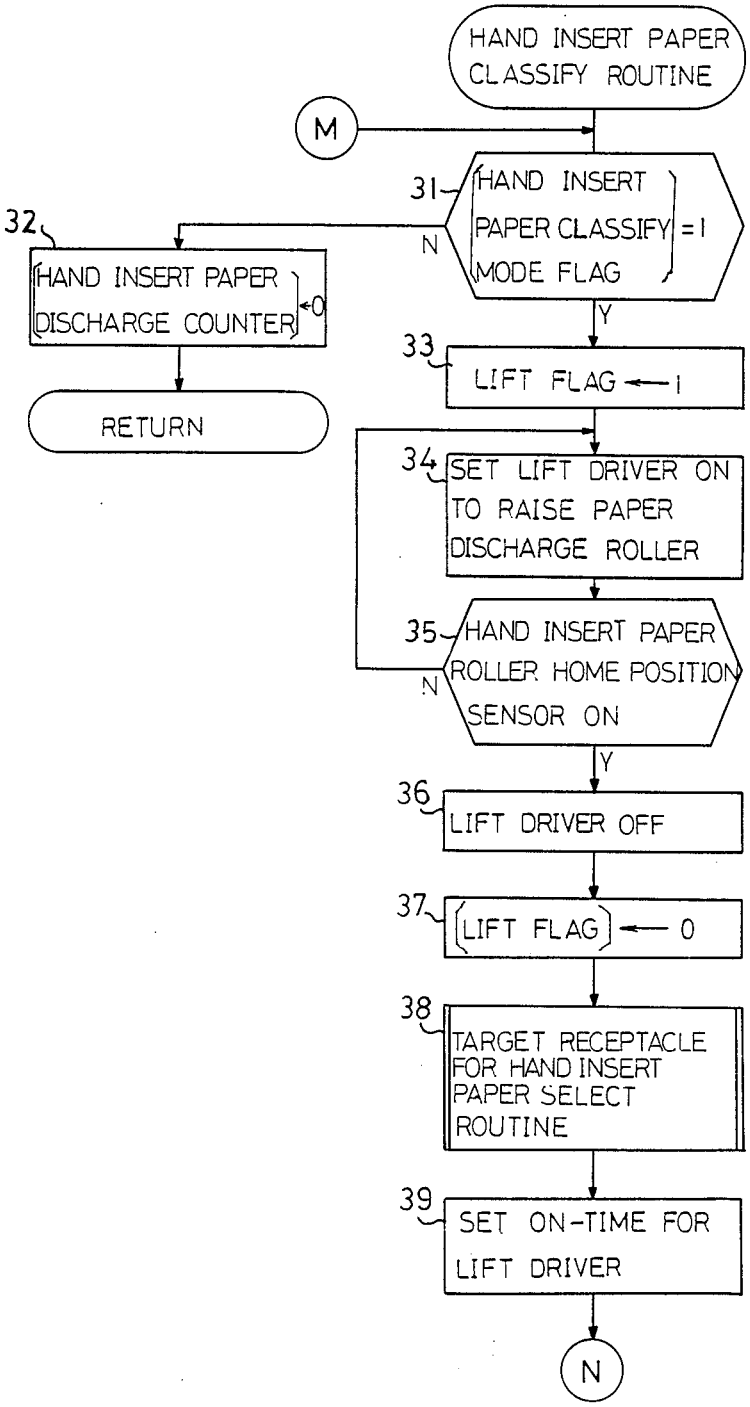
Figure 25B:
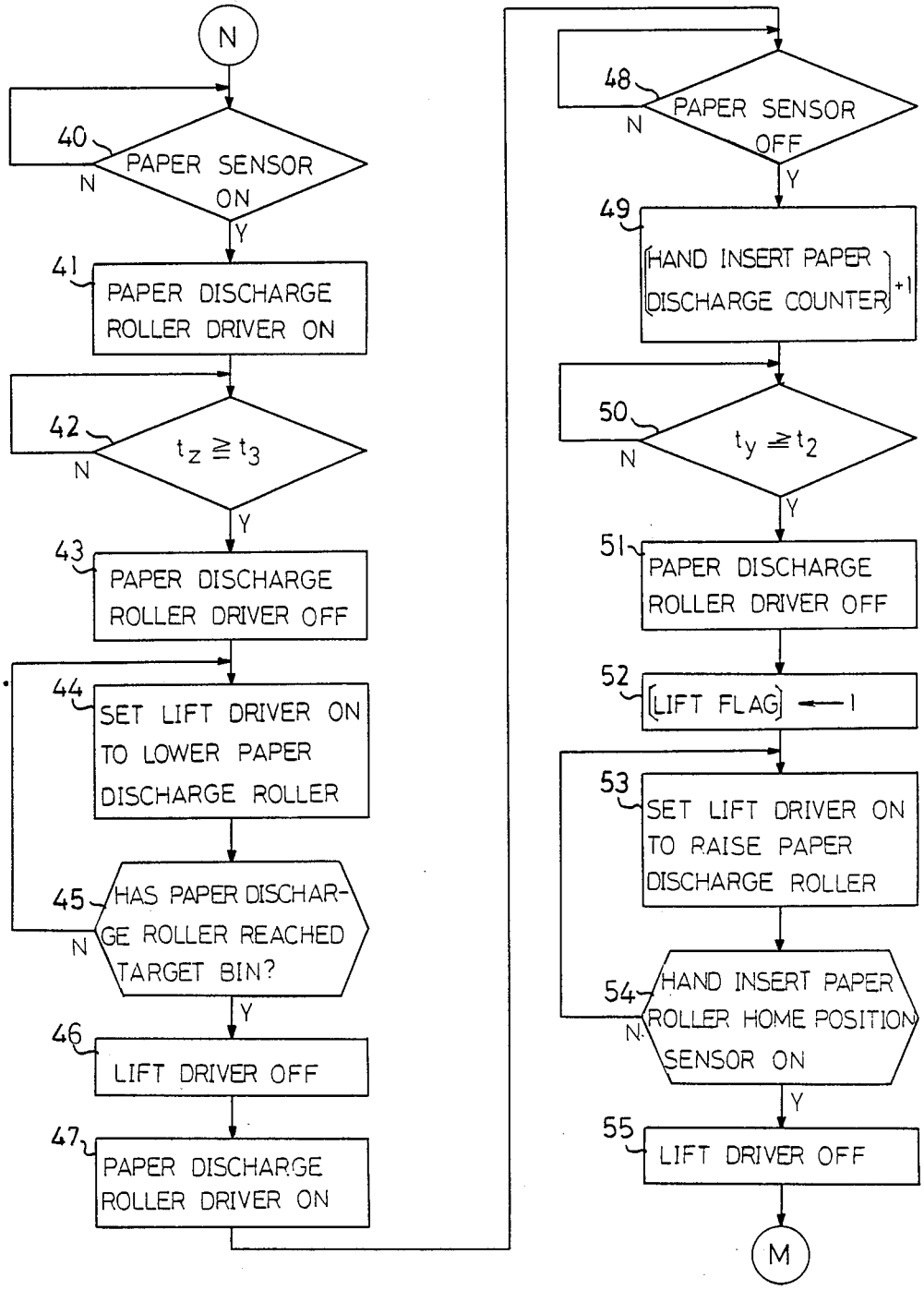

FIGS. 25*a* and 25*b* show a hand insert sort routine. Step 31 checks if hand insert sort mode flag = 1 or not. If Step 31 determines that hand insert sort mode flag is not equal to "1", the flow returns back to the main routine after Step 32 clears a value of hand insert discharged paper counter to 0.

If Step 31 determines hand insert sort mode flag = 1, Step 33 makes lift flag "1", Step 34 turns ON the lift driver 12 to lift the paper discharge rollers 15 and 21, and Step 35 checks if the hand insert paper roller home position sensor 427 is turned ON or not. If Step 35 determines that the hand insert paper roller home position sensor 427 is not turned ON, the flow returns to Step 34 to hold the lift driver 12 ON.

If the aforesaid Step 35 determines that the hand insert paper home position sensor 427 is ON, the flow advances to Step 36 wherein the lift driver 12 is turned OFF, Step 37 makes lift flag "0", and, through the hand insert paper target receptacle select routine in Step 38, Step 39 sets ON-time of the lift driver 12, and then Step 40 checks if the paper sensor 23 is ON or not.

If the aforesaid Step 40 determines that the paper sensor 23 is ON, Step 41 turns the paper discharge roller driver 22 ON, and then Step 42 checks if $t_z \geqq t_3$ or not, where $t_z$ is an elapsed time from the instant when Step 40 turns ON the paper sensor 23, and $t_3$ a time, from the instant when the paper sensor 23 is turned ON in Step 40, required for a leading edge of recorded paper P to be pinched in between paired discharge rollers 15 and 21.

If Step 42 determines $t_z \geqq t_3$, Step 43 turns OFF the paper discharge roller driver 22, Step 44 turns ON the lift driver 12 to lower the paper discharge rollers 15 and 21, and then Step 45 checks if the paper discharge rollers 15 and 21 have reached the selected receptacle 9 or not, i.e., if the lift driver 12 has been kept ON for the ON-time of the lift driver 12 set in Step 39.

If the aforesaid Step 45 determines that the paper discharge rollers 15 and 21 have not reached the selected receptacle 9, the flow returns to Step 44 to hold the lift driver 12 ON. If Step 45 determines that the paper discharge rollers 15 and 21 have reached the selected receptacle 9, Step 46 turns OFF the lift driver 12, Step 47 turns ON the paper discharge roller driver 22, and then Step 48 checks if the paper sensor 23 is OFF or not. If Step 48 determines that the paper sensor 23 is OFF, Step 49 adds 1 to hand insert paper discharge counter, and then Step 50 checks if $t_y \geqq t_2$ or not, where $t_y$ is an elapsed time from the instant when Step 48 turned OFF the paper sensor 23, and $t_2$ is a time, from the instant when the paper sensor 23 turned OFF, required for recorded sheet P' discharged by the paper discharge rollers 15 and 21 to get out of the paper discharge rollers 15 and 21.

If the aforesaid Step 50 determines $t_y \geqq t_2$, Step 51 turns OFF the paper discharge roller driver 22, Step 52 makes lift flag "1", Step 53 turns ON the lift driver 12 to lift the paper discharge rollers 15 and 21, and then Step 54 checks if the hand insert paper roller home position sensor 27 is ON or not. If Step 54 determines that the hand insert paper roller home position sensor 27 is not turned ON, the flow returns to Step 53 to hold the lift driver 12 ON. If Step 54 determines that the hand insert paper roller home position sensor 27 is turned ON, Step 55 turns OFF the lift driver 12, and the flow returns to Step 31.

Figure 26:
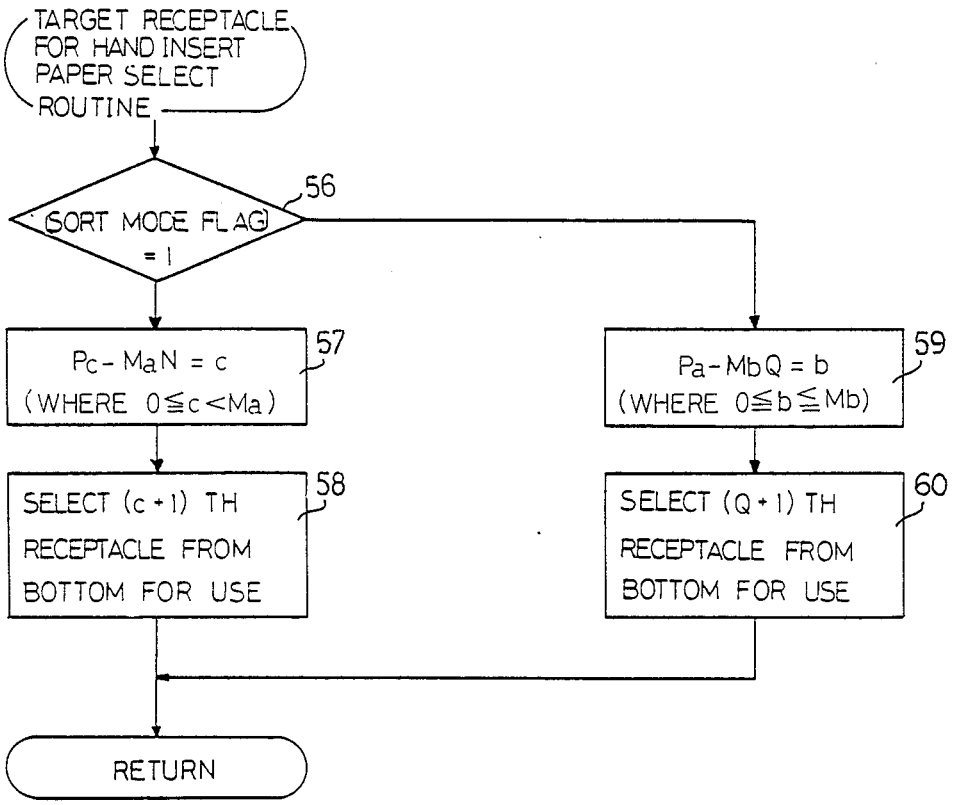

FIGS. 26 illustrates the hand insert paper target receptacle select routine, Step 38, in FIG. 25*a*.

First, Step 56 checks if sort mode flag = 1 or not. If Step 56 determines sort mode flag = 1, Step 57 finds N and C to satisfy $P_c - M_a N = C$ (where $0 \leqq C \leqq M_a$), where $P_c$ is a value of the hand insert paper discharge counter, $M_a$ that of the target receptacle No. counter, and N and C are 0 or positive integers. Using C solved in Step 57, Step 58 selects a (C + 1) th receptacle 9 from bottom as a target receptacle 9 to return back to the main routine.

If the aforesaid Step 56 determines that sort mode flag is not equal to 1, Step 59 finds Q and b to satisfy $P_a - M_b Q = b$ (where $0 \leqq b \leqq M_b$), where $M_b$ is a maximum number of recorded sheets P stacked in a receptacle 9, and Q and b are 0 or positive integers. Using Q solved in Step 59, Step 60 selects a (Q + 1) th receptacle 9 from bottom as a target receptacle 9 to return to the main routine.

According to the aforesaid embodiment provided with a paper hand insert port 425, recorded sheets manually inserted can be sorted onto receptacles.

Figure 27:
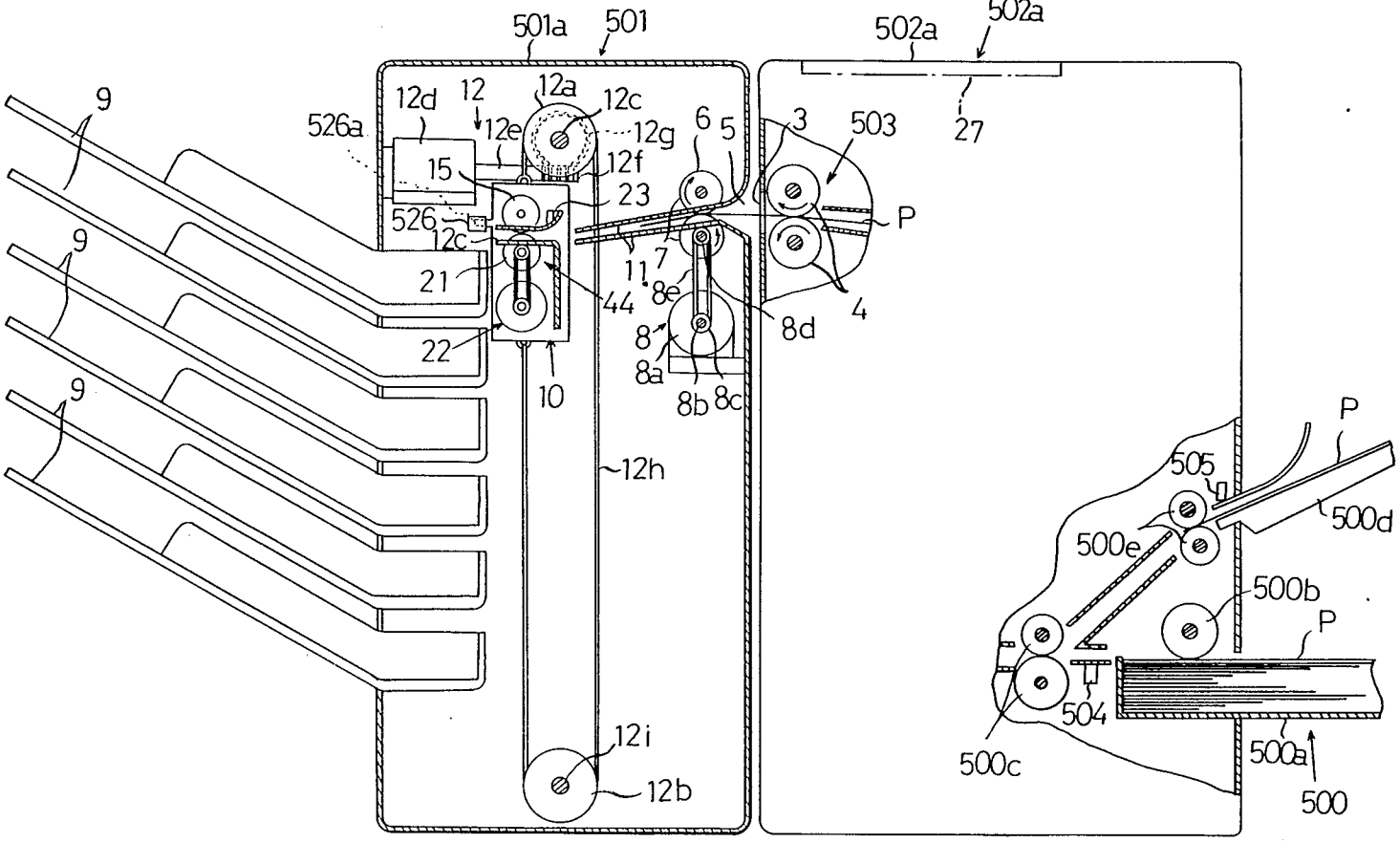
FIG. 27 is a side sectional view of a fourth embodiment.

FIG. 27 shows a further separate embodiment according to the invention. A sorter 501 according to the embodiment is applicable to an electronic copying machine 502 having a function to automatically feed, one by one, recording sheets in a paper feed cassette, and a function to manually insert, one by one, recording sheets from a hand insert tray 500*d*.

The aforesaid paper feeder 500 consists of a paper feed cassette 500*a* removable and stackable with a plurality of recording sheets P therein, a paper feed roller 500*b* sucessively feeding, one by one, recording sheets P stacked in the paper feed cassette 500*a*, a pair of register rollers 500*c* disposed on a paper feed direction side of the paper feed roller 500*b*, a hand insert tray 500*d* disposed above the paper feed cassette 500*a* to receive recording sheets P manually inserted, and a pair of hand insert paper feed rollers 500*e* feeding manually inserted recording sheets P set on the hand insert tray 500*d*, toward the register rollers 500*c*.

A paper feed sensor 504 is provided on the paper feed direction side of the aforesaid paper feed rollers 500*b*. The paper feed sensor 504 is of a photosensor type. Near the aforesaid hand insert tray 500*d*, a hand feed paper sensor 505 is disposed to detect that a recording sheet P is so placed on the hand insert tray 500*d* that it is ready to be fed. The hand insert paper sensor 505 is also of a photosensor type.

The aforesaid paper feeder 500, when the hand insert paper sensor 505 does not detect a recording sheet P, i.e., when no recording sheet P is placed on the hand insert tray 500*d*, succesively feeds, one by one, recording sheets P stacked in the paper feed cassette 500*a*, and, when the hand insert paper sensor 505 detects a recording sheet P on the hand insert tray 500*d*, can feed the recording sheet P on the hand insert tray 500*d* by the hand insert paper feed rollers 500*e*, prior to recording sheets P stacked in the paper feed cassette 500*a*.

A paper discharger 503 consists of a pair of paper discharge rollers 4 etc. A paper discharge port 3 is provided in an outer casing 502*a* at a position corresponding to a recorded sheet discharge direction of the paper discharge rollers 4.

The sorter 501 is disposed adjacent to the paper discharge port 3. The home position of a lift member 10 in the sorter 501 is located at a position matching the top receptacle 9. A roller home position sensor 526 and a detect piece 526*a* projecting on the lift member 10 detect if the lift member 10 is standing by at the home position or not.

Figure 28:
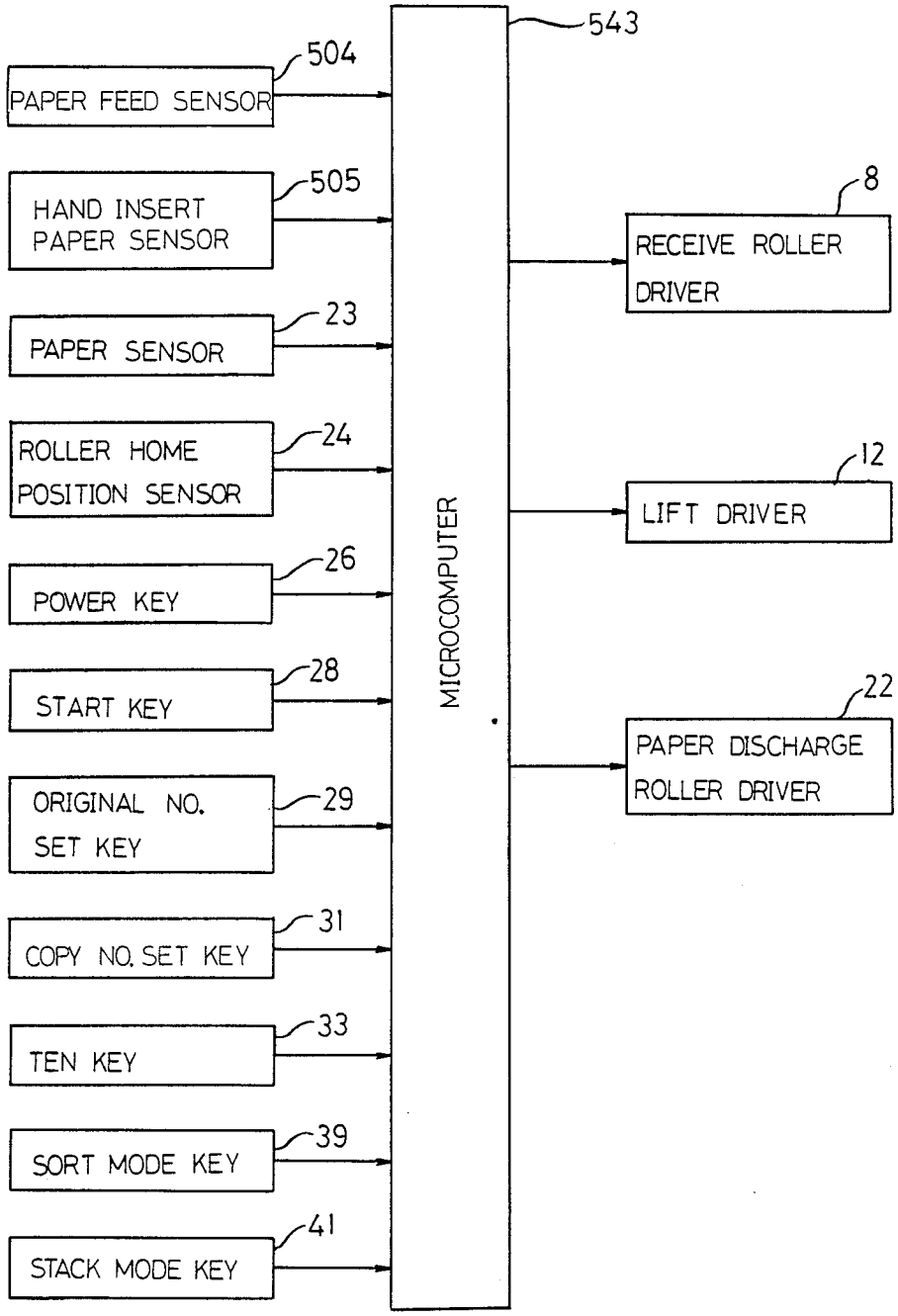
FIG. 28 is a block diagram of a control device of the fourth embodiment.

FIG. 28 shows functional blocks of a control device for the sorter 501, which is different from the aforesaid in FIG. 6 in that a paper feed sensor 504 and a hand insert paper sensor 505 are also connected to an input port of a microcomputer 543. In RAM in the microcomputer 543, a fed paper No. counter and a hand insert paper flag are additionally stored.

FIGS. 29*a* to 32 show flow charts of a typical operation of the sorter 501.

First, Step 1 initializes the microcomputer 543, to clear RAM and I/O ports in the microcomputer 543.

Second, Step 2 checks if a START key 28 is turned ON or not. If Step 2 determines the START key is ON, Step 3 turns ON a receive roller driver 8, and then, through a target receptacle select routine or Step 4, Step 5 sets an ON-time of the lift driver 12 matching a receptacle 9 selected in the target receptacle select routine.

Next, through a fed paper No. count routine or Step 6, Step 7 checks if the paper sensor 23 is ON or not. If Step 7 determines the paper sensor 23 is not ON, the flow returns to Step 4. If Step 7 determines the paper sensor 23 is ON, i.e. if the paper sensor 23 detects a leading edge of recorded sheet P, Step 8 turns ON the paper discharge roller driver 22, and Step 9 checks if $t_x \geqq t_1$ or not, where $t_x$ is an elapsed time from the instant the paper sensor 23 was turned ON, and $t_1$ is a time, from the instant when the paper sensor 23 was turned ON (when the paper discharge roller driver was turned ON), required for a leading edge of recorded sheet P to be pinched in between the paper discharge rollers 15 and 21. If Step 9 determines $t_x$ is smaller than $t_1$, the flow returns to Step 4.

If Step 9 determines $t_x \geqq t_1$, Step 10 turns OFF the paper discharge roller driver 22, Step 11 makes lift flag "1", and then Step 12 checks if hand insert paper flag=0 or not. If Step 12 determines hand insert paper Flag=0, Step 13 turns ON the lift driver 12 to lower (move forward) the paper discharge rollers 15 and 21. Next, through Step 14, feed paper No. count routine, Step 15 checks if the paper discharge rollers 15 and 21 have reached a receptacle 9 selected in the target receptacle select routine or not, i.e., if the lift driver 12 has been kept ON for the ON-time set in Step 5 or not.

If Step 15 determines the paper discharge rollers 15 and 21 have not yet reached the selected receptacle 9, the flow returns to Step 13 to hold the lift driver 12 ON. If Step determines the paper discharge rollers 15 and 21 have reached the selected receptacle 9, Step 16 turns the lift driver 12 OFF, and Step 17 turns the paper discharge roller driver 22 ON. If the aforesaid Step 12 determines hand insert paper flag is not 0, the flow goes to Step 17. Step 17 turns the paper discharge roller driver 22 ON, and, through Step 18, feed paper No. count routine and Step 19, discharged paper No. count routine, Step 20 checks if the paper sensor 23 is OFF or not.

If the aforesaid Step 20 determines the paper sensor 23 is not OFF, the flow returns to Step 17. If Step 20 determines that the paper sensor 23 is OF, i.e., that the paper sensor 23 has detected a trailing edge of recorded sheet P, Step 21 checks if $t_y \geqq t_2$, where $t_y$ is an elapsed time from the instant when Step 20 determined the paper sensor 23 was OF, and $t_2$ is a time, from the instant when Step 20 determined the paper sensor 23 was OFF, required for recorded sheet P discharged from the paper discharge rollers 15 and 21 to get out of the paper discharge rollers 15 and 21.

If the aforesaid Step 21 determines $t_y \geqq t_2$, Step 22 turns the paper discharge roller driver 22 OF, Step 23 makes lift flag "0", and Step 24 turns the lift driver 12 ON to lift (move backward) the paper discharge rollers 15 and 21. Next, through Step 25, feed paper No. count routine, Step 26 checks if the roller home position sensor 526 is turned ON or not. If Step 26 determines the roller home position sensor 526 is not turned ON, the flow goes to Step 24 to hold the lift driver 12 ON.

If Step 26 determines the roller home position sensor 526 is ON, Step 27 turns the lift driver 12 OFF to keep the paper discharge rollers 15 and 21 at the home position, Step 28 makes hand insert paper flag "0", and then Step 29 checks if total copy set No. counter=discharged paper No. counter or not. If Step 29 determines total set No counter is not equal to discharged total copy set No. counter=discharge paper No. counter, a complete cycle of this operation is over.

Figure 29A:
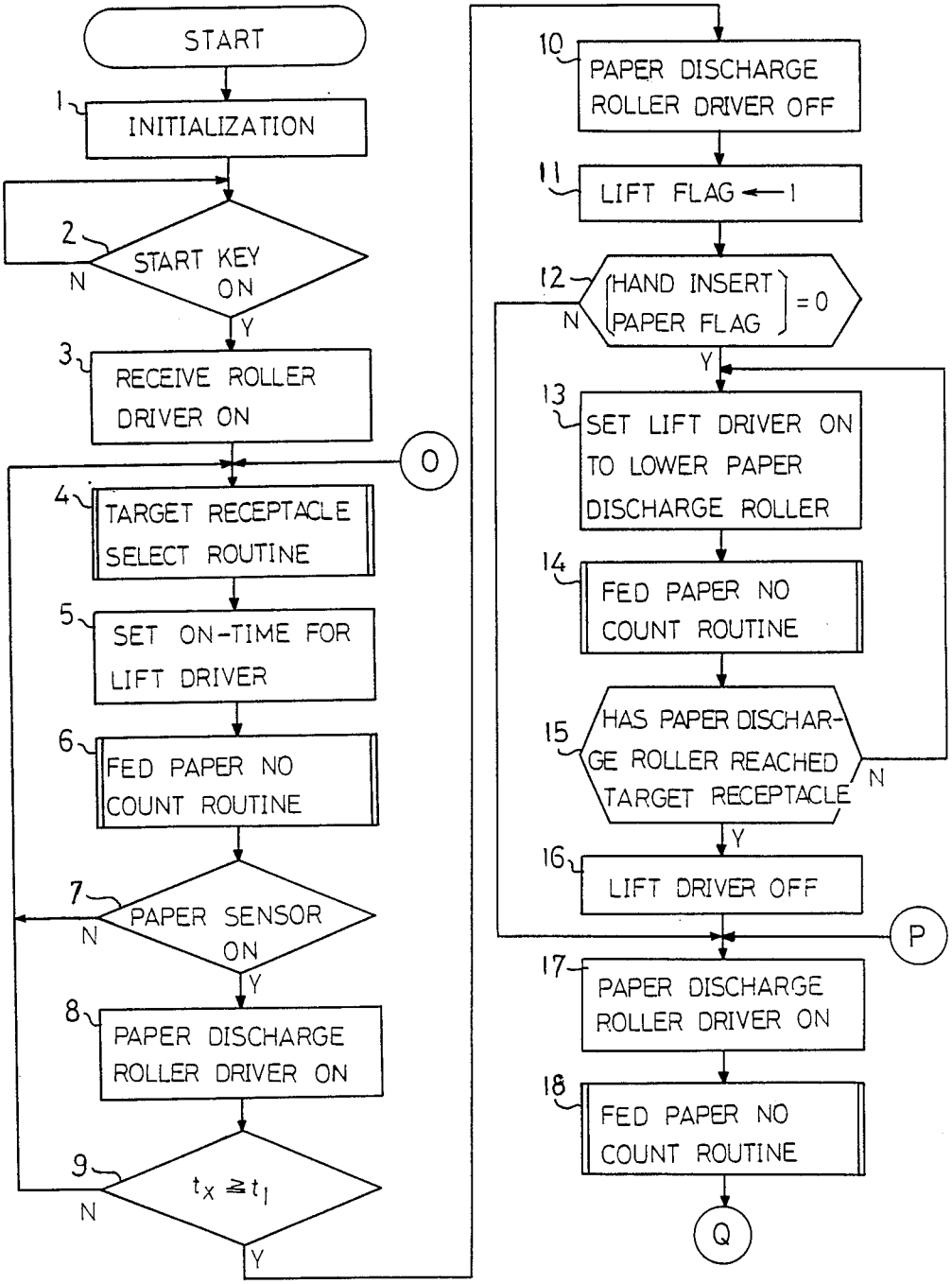
FIGS. 29*a*, 29*b*, 30, 31 and 32 are control flow charts of the control device in FIG. 28.
Figure 29B:
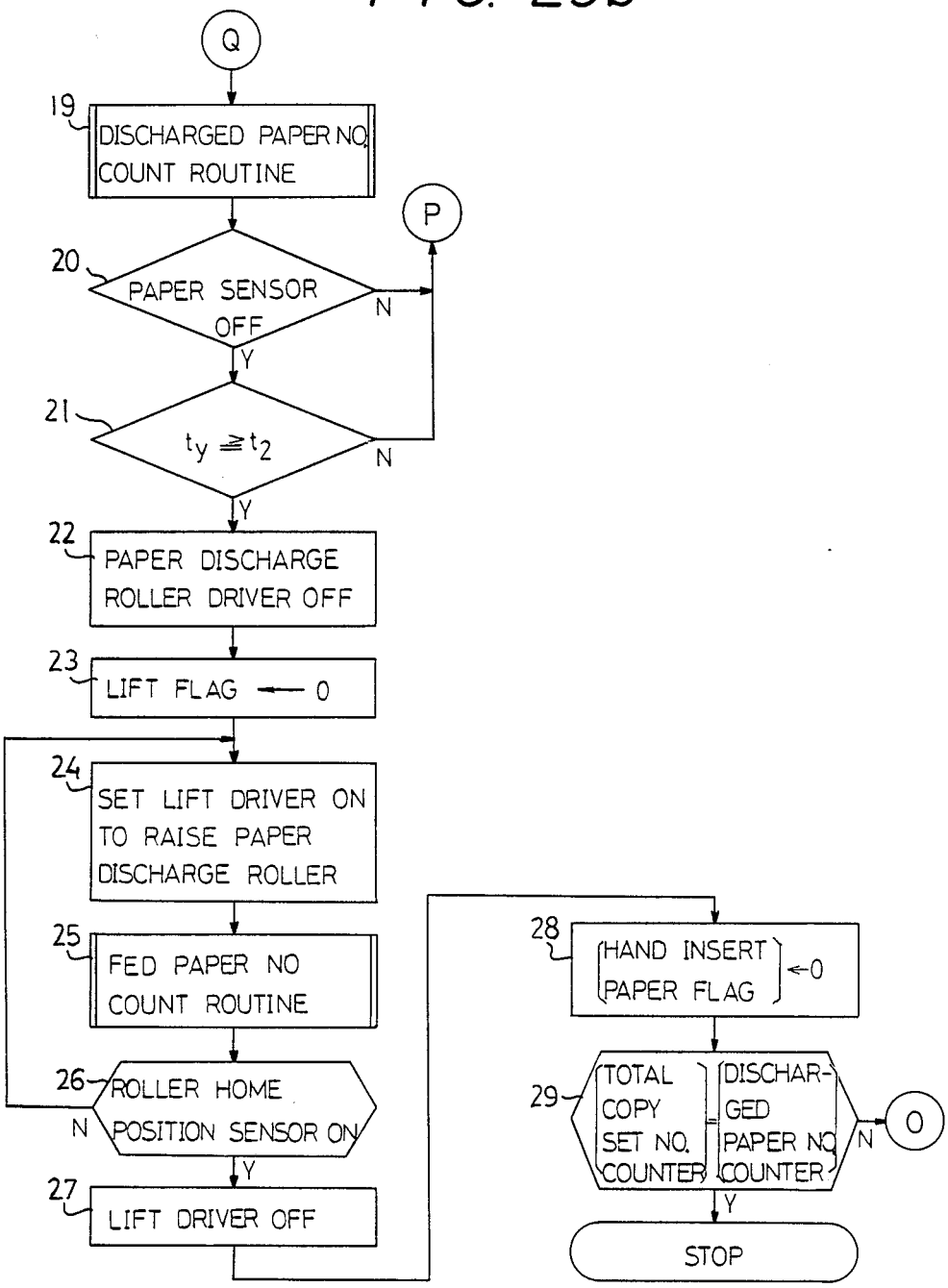
Figure 30:
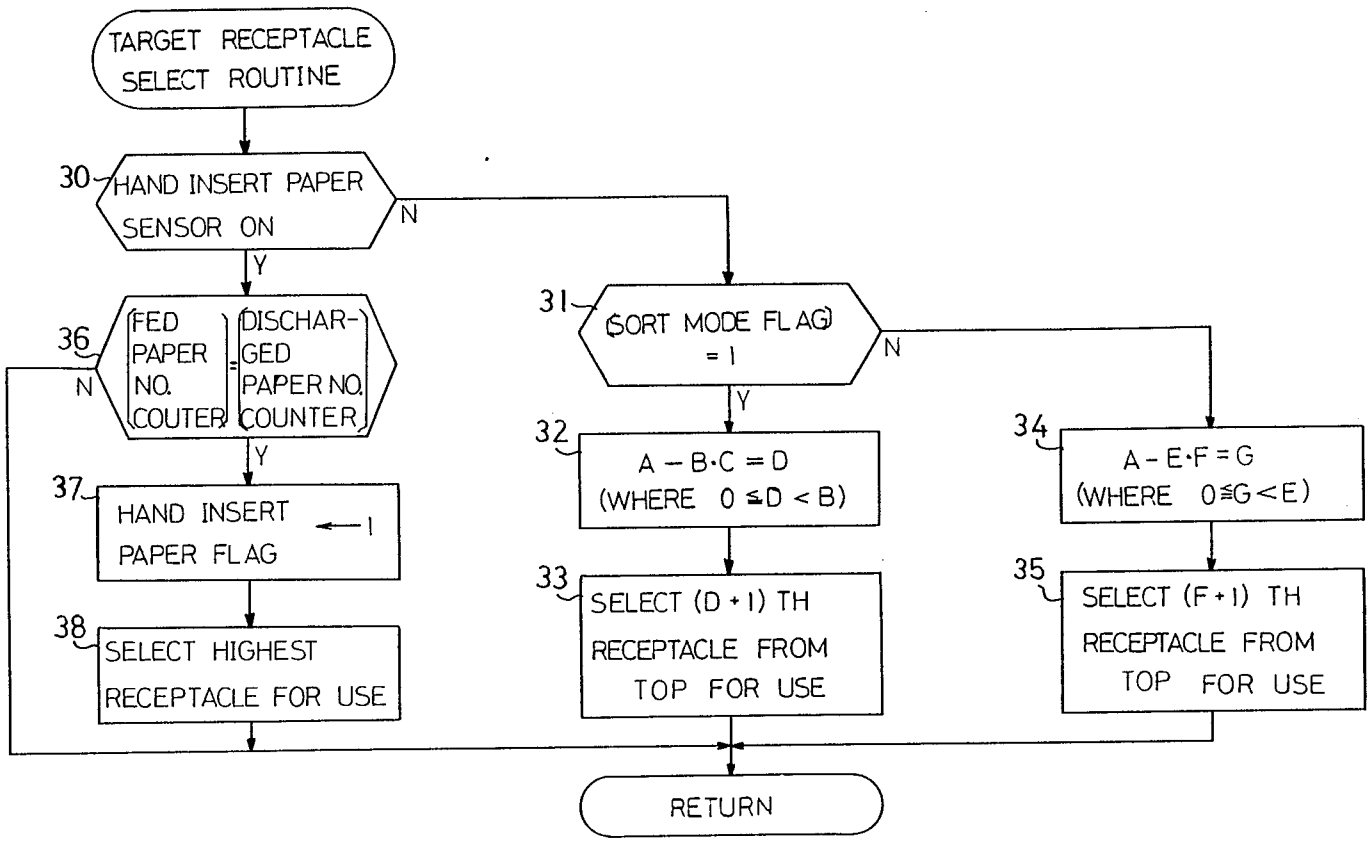

FIG. 30 illustrates a target receptacle select routine, Step 4 in FIG. 29*a*. Step 30 checks if the hand insert paper sensor 505 is turned ON or not. If Step 30 determines the hand insert paper sensor 505 is not turned ON, Step 31 checks if sort mode flag=1 or not. If Step 31 determines sort mode flag=1, i.e., the current mode is "sort mode", Step 32 finds C and D to satisfy $A-BC=D$ (where $0 \leqq D < B$), where A is a value of the discharged paper counter, B one of the target receptacle No. counter, and C and D are 0 or positive integers. Using D found in Step 32, Step 33 selects a (D+1) th receptacle 9 from top as a target receptacle 9, to return to the main routine.

If the aforesaid Step 31 determines sort mode flag is not equal to 1, Step 34 finds F and G to satisfy $A-EF=G$ (where $0 \leqq G \leqq E$), where E is a maximum number of recorded sheets P stacked on a receptacle 9, and F and G are 0 or positive integers. Using F solved in Step 34, Step 35 selects a (F+1) th receptacle 9 from top as a target receptacle 9 to return to the main routine.

If the aforesaid Step 30 determines the hand insert paper sensor 505 is ON, Step 36 checks if feed paper No. counter=discharged paper No. counter or not. If Step 36 determines feed paper No. counter is not discharged paper No. counter, i.e., that recorded sheets P fed from the paper feed cassette 500*a* remain within the electronic copying machine 502 or the sorter 501, and have not been discharged out to receptacles 9, the flow returns to the main routine.

If the aforesaid Step 36 determines feed paper No. counter=discharged paper No. counter, i.e., that all recorded sheets P fed from the paper feed cassette 500*a* have been discharged to receptacles 9 in the sorter 501, Step 37 makes hand insert paper flag "1", and Step 38 selects a top receptacle 9 as a target receptacle 9 to return to the maine routine.

Figure 31:
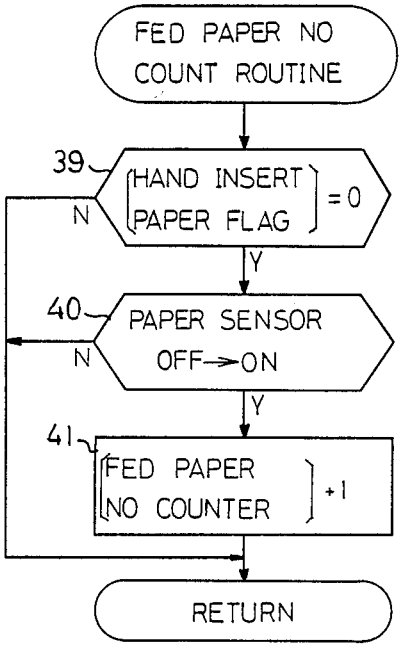

FIG. 31 illustrates feed paper No. count routine, the aforesaid Steps 6, 14, 18 and 25.

Step 39 checks if hand insert paper flag=0 or not. If Step 39 determines hand insert paper flag=0, i.e., that recording sheets P in the paper feed cassette 500*a* are to be fed, Step 40 checks if the paper feed sensor 504 has turned ON from OFF. If Step 40 determines the paper feed sensor 504 has turned ON from OFF, Step 41 adds "1" to feed paper No. counter, to return to the main routine. If Step 39 determines hand insert paper flag is not 0, i.e., that a recording sheet P loaded on the hand insert tray 500*d* is to be fed, or if Step 40 determines the paper feed sensor 504 has not yet turned ON from OFF, the flow goes to the main routine.

Figure 32:
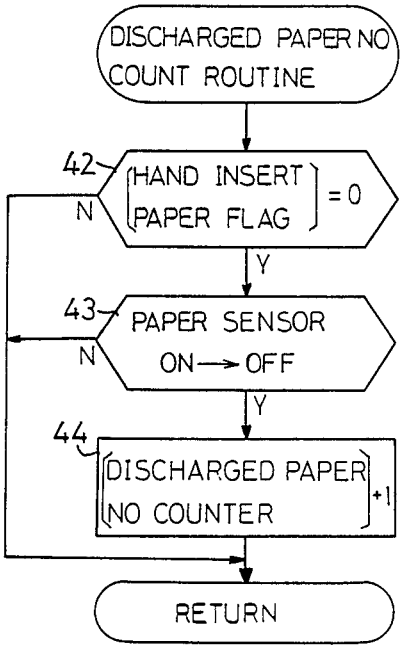

FIG. 32 illustrates discharged paper No. count routine, Step 19.

Step 42 checks if hand insert paper flag=0 or not. If Step 42 determines hand insert paper flag=0, Step 43 checks if the paper sensor 23 has turned OFF from ON. If Step 43 determines the paper sensor 23 has turned OFF from ON, Step 44 adds "1" to discharged paper No. counter to return to the main routine. If the aforesaid Step 42 determines hand insert paper flag is not 0, or if Step 43 determines the paper sensor 23 has not yet turned OFF from ON, the flow goes to the main routine.

Figure 33:
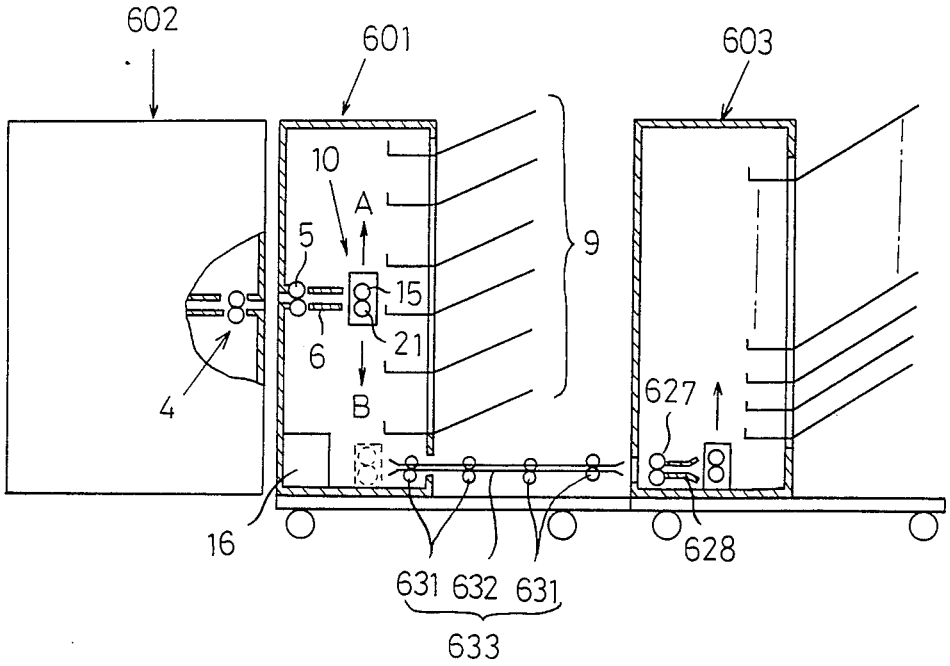
FIGS. 33 and 34 are side sectional views of a fifth embodiment.

As described above, according to the sorter 501, when discharging manually inserted recorded sheets to the receptacle 9, the sorter 501 can discharge recorded sheets to the receptacle 9 without the lift member 10 but keeping it at the home position. As a result, this method can essentially eliminate the need for bending recorded sheets, thus promising a successful discharge of thicker or thinner hand insert recording sheets FIG. 33 shows an embodiment where a sorter according to the invention is connected to another sorter. A first sorter 601 is a sorter directly associated with the embodiment, to which a second sorter 603 is connected. The first sorter 601 includes a plurality of receptacles 9, a lift member 10, paper discharge rollers 15 and 21. These main parts and their associated members are similar to those in the embodiment shown in FIG. 1.

The sorter 601 is different from the aforesaid sorters in that a recorded paper carrier 633 consisting of recorded paper carry rollers 631 and a recorded paper carry path 632 is provided on the bottom of the sorter 601. The recorded paper carrier 633 is aligned with paper receive rollers 627 and a recorded paper receive carry path 628. The recorded paper carrier 633 can instead be mounted at other vertical positions. Thus it may be mounted for example at a substantially central position, as shown in FIG. 34.

As described above, recorded sheets are discharged from an electronic copying machine, an image recording device, and successively sorted one by one by the lift member 10 to receptacles 9. There may be a case in which too many sheets of recording paper are discharged from the copying machine 602 for the receptacles 9 in the first sorter 601. In such a case, excess recorded sheets are carried to the recorded paper carrier 633 by paper discharge rollers 15 and 21, and further carried into the second sorter 603 by rollers 631, thus compensating shortages of receptacles in the first sorter 601 by the second sorter 603.

To transfer recorded sheets from the first sorter 601 to the second sorter 603, this embodiment employs vertically movable paper discharge rollers 15 and 21 to carry them to the recorded paper carrier 633. Therefore, the position of paper carrier 633 is not limited to the position on the bottom of the first sorter 601 as shown in FIG. 33, the recorded paper carrier 633 can be arranged at any vertical position in the first sorter 601. This means that the embodiment can cope with a recording paper receive port disposed at any position (for example, the recording paper receive rollers 627 and the recording paper receive carry path 628 in the embodiment) in the second sorter 603.

Figure 34:
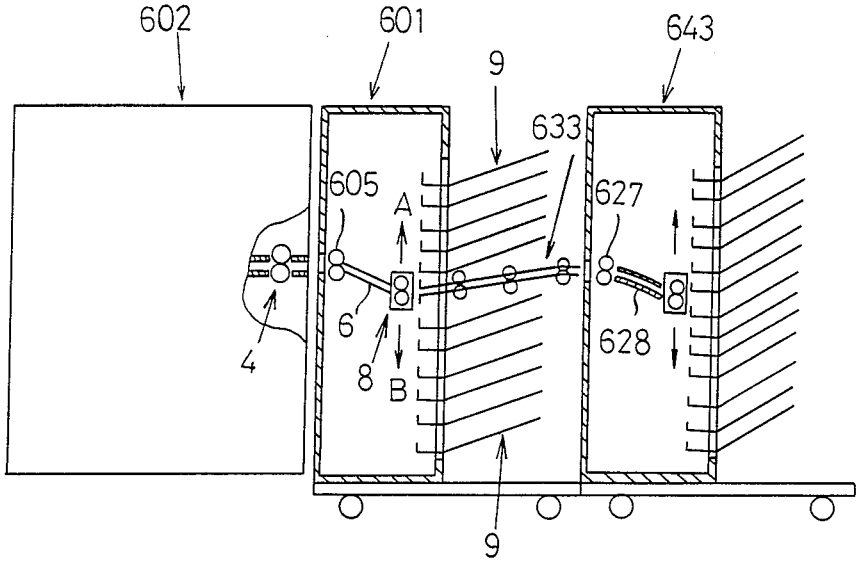

For example, as shown in FIG. 34, if recording paper receive rollers 627 etc. in a second sorter 643 are disposed at a substantially central position similar to recording paper receive rollers 605 etc. in the first sorter 601, a recording paper carrier 633 would be placed at a nearly central position of the train of receptacles 9 as shown in the figure.

It will be clear to those skilled in the art that various changes may be made in the invention without departing from the spirit and scope thereof and therefore the invention is not limited by that which is shown in the drawings and described in the specification but only as indicated in the appended claims.

What is claimed is:

1. A sorter comprising:

a plurality of receptacles vertically disposed at given intervals, a lift member disposed close to said receptacles and movable up and down, a lift drive means for raising and lowering said lift member, a recorded sheet pinch means disposed on said lift member to momentarily hold recorded sheets discharged to the sorter, a recorded sheet discharge means disposed on said lift member to transfer recorded sheets to the receptacles, and drive means for driving one of said recorded sheet pinch means and said recorded sheet discharge means, control means including means to control said lift drive means such that said lift member stands at a given home position to receive a recorded sheet and moves to a target position while holding the recorded sheet received using said recorded sheet pinch means, said control means further including means for controlling said recorded sheet discharge means to discharge the recorded sheet onto the target receptacle, and said control means yet further including means for returning said lift member to said home position from said target position, wherein said drive means for one of said recorded sheet pinch means and said recorded sheet discharge means is disposed on said lift member, and wherein said lift drive means is not disposed on said lift means.

2. A sorter as claimed in claim 1, wherein said lift drive means comprises a step motor for raising and lowering said lift member, and wherein said control means includes means to drive said step motor for a predetermined period of time to move said lift member from said home position to said target position.

3. A sorter comprising:

a plurality of receptacles vertically disposed at given intervals, a lift member disposed close to said receptacles and movable up and down, a lift drive means for raising and lowering said lift member, a recorded sheet pinch means disposed on said lift member to momentarily hold recorded sheets discharged to the sorter, a recorded sheet discharge means disposed on said lift member to transfer recorded sheets to the receptacles, a drive means for driving one of said recorded sheet pinch means and said recorded sheet discharge means, control means including means to control said lift drive means such that said lift member stands by a given home position to receive a recorded sheet and moves to a target position while holding the recorded sheet received using said recorded sheet pinch means, said control means further including means for controlling said paper discharge means to discharge the recorded sheet onto the target receptacle; and said control means yet further including means for returning said lift member to said home position from said target position, and a sheet detecting means disposed on said lift member to detect the sheet fed into said sheet pinch means, said control means controlling one of said drive means for said recorded sheet pinch means and said recorded sheet discharge means based on a time when said sheet detecting means detects the sheet.

4. A sorter as claimed in claim 3, wherein said drive means for one of said recorded sheet pinch means and said recorded sheet discharge means is disposed on said lift member.

5. A sorter comprising:

a plurality of receptacles vertically disposed at given intervals, a lift member disposed close to said receptacles and movable up and down, a lift drive means for raising and lowering said lift member, a recorded sheet pinch means disposed on said lift member to momentarily hold recorded sheets discharged to the sorter, a recorded sheet discharge means disposed on said lift member to transfer recorded sheets to the receptacles, a drive means for driving one of said recorded sheet pinch means and said recorded sheet discharge means, and control means including means to control said lift drive means such that said lift member stands by a given home position to receive a recorded sheet and moves to a target position while holding the recorded sheet received using said recorded sheet pinch means, said control means further including means for controlling said paper discharge means to discharge the recorded sheet onto the target receptacle, and said control means yet further including means for returning said lift member to said home position from said target position, wherein said recorded sheet pinch means and said recorded sheet discharge means are formed by a common means.

6. A sorter as claimed in claim 5, wherein said common means comprises a pair of rollers for holding and discharging the sheet and a pair of guide members for guiding the sheet to pass through between said rollers.

7. A sorter as claimed in claim 5, wherein said drive means for one of said recorded sheet pinch means and said recorded sheet discharge means is disposed on said lift member.

8. A sorter as claimed in claim 5, further comprising a sheet detecting means disposed on said lift member to detect the sheet fed into said sheet pinch means, wherein said control means controls said drive means for one of said recorded sheet pinch means and said recorded sheet discharge means based on a time when said sheet detecting means detects the sheet.

9. A sorter as claimed in claim 5, wherein said recorded sheet pinch means comprises a pair of rollers for holding the sheet and a means to prevent said pair of rollers from rotating in a direction opposite to a sheet discharge direction.

10. A sorter comprising:

a plurality of receptacles vertically disposed at given intervals, a lift member disposed close to said receptacles and movable up and down, a lift drive means for raising and lowering said lift member, a recorded sheet pinch means disposed on said lift member to momentarily hold recorded sheets discharged to the sorter, a recorded sheet discharge means disposed on said lift member to transfer recorded sheets to the receptacles, a drive means for driving one of said recorded sheet pinch means and said recorded sheet discharge means, and control means including means to control said lift drive means such that said lift member stands by a given home position to receive a recorded sheet and moves to a target position while holding the recorded sheet received using said recorded sheet pinch means, said control means further including means for controlling said paper discharge means to discharge the recorded sheet onto the target receptacle, said control means further including means for returning said lift member to said home position from said target position and said control means yet further including means to control said lift drive means so that the speed of said lift member is faster than the discharge speed of the recorded sheet transferred from an image recording machine.

11. A sorter as claimed in claim 10, wherein said control means includes means to control said lift drive means so that the speed at which said lift member moves from said home position to said target position is substantially the same as the discharge speed of the recorded sheet transferred from the image recording machine, and so that the speed at which said lift member returns from said target position to said home position is faster than said sheet discharge speed from the image recording machine.

12. A sorter as claimed in claim 11, wherein said lift drive means comprises a step motor for raising and lowering said lift member, and wherein said control means includes means to drive said step motor for a predetermined period of time to move said lift member from said home position to said target position.

13. A sorter as claimed in claim 10, wherein said lift drive means comprises a step motor for raising and lowering said lift member, and wherein said control means includes means to drive said step motor for a predetermined period of time to move said lift member from said home position to said target position.

14. A sorter comprising:

a plurality of receptacles vertically disposed at given intervals, a lift member disposed close to said receptacles and movable up and down, a lift drive means for raising and lowering said lift member, a recorded sheet pinch means disposed on said lift member to momentarily hold recorded sheets discharged to the sorter, a recorded sheet discharge means disposed on said lift member to transfer recorded sheets to the receptacles, a drive means for driving one of said recorded sheet pinch means and said recorded sheet discharge means, and control means including means to control said lift drive means such that said lift member stands by a given home position to receive a recorded sheet and moves to a target position while holding the recorded sheet received using said recorded sheet pinch means, said control means further including means for controlling said paper discharge means to discharge the recorded sheet onto the target receptacle, and said control means yet further including means for returning said lift member to said home position from said target position, said recorded sheet pinch means having a sheet draw preventing means for preventing the sheet held by said recorded sheet pinch means from being drawn out of said recorded sheet pinch means.

15. A sorter as claimed in claim 14, wherein said recorded sheet pinch means comprises a pair of rollers for holding the sheet, and wherein said sheet draw preventing means comprising a means to prevent said pair of rollers from rotating in a direction opposite to sheet discharging direction.

16. A sorter comprising:

a plurality of receptacles vertically disposed at given intervals, a lift member disposed close to said receptacles and movable up and down, a lift drive means for raising and lowering said lift member, a recorded sheet pinch means disposed on said lift member to momentarily hold recorded sheets discharged to the sorter, a recorded sheet discharge means disposed on said lift member to transfer recorded sheets to the receptacles, a drive means for driving one of said recorded sheet pinch means and said recorded sheet discharge means, and control means including means to control said lift drive means such that said lift member stands by a given home position to receive a recorded sheet and moves to a target position while holding the recorded sheet received using said recorded sheet pinch means, said control means further including means for controlling said paper discharge means to discharge the recorded sheet onto the target receptacle, and said control means yet further including means for returning said lift member to said home position from said target position, said home position being located to match one of said receptacles other than the highest and the lowest receptacles, and said control means including means to control said lift drive means to raise and lower said lift member from said home position.

17. A sorter comprising:

a plurality of receptacles vertically disposed at given intervals, a lift member disposed close to said receptacles and movable up and down, a lift drive means for raising and lowering said lift member, a recorded sheet pinch means disposed on said lift member to momentarily hold recorded sheets discharged to the sorter, a recorded sheet discharge means disposed on said lift member to transfer recorded sheets to the receptacles, a drive means for driving one of said recorded sheet pinch means and said recorded sheet discharge means, and control means including means to control said lift drive means such that said lift member stands by a given home position to receive a recorded sheet and moves to a target position while holding the recorded sheet received using said recorded sheet pinch means, said control means further including means for controlling said paper discharge means to discharge the recorded sheet onto the target receptacle, and said control means yet further including means for returning said lift member to said home position from said target position, said home position being located to match the lowest receptacle among said plurality of receptacles.

* * * * *